US011612198B2

(12) United States Patent
Koshkaroff

(10) Patent No.: US 11,612,198 B2
(45) Date of Patent: Mar. 28, 2023

(54) STOWABLE ARTICLE OF APPAREL AND APPAREL SYSTEM

(71) Applicant: NIKE, Inc., Beaverton, OR (US)

(72) Inventor: Iustinia Koshkaroff, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/716,759

(22) Filed: Apr. 8, 2022

(65) Prior Publication Data

US 2022/0225706 A1 Jul. 21, 2022

Related U.S. Application Data

(63) Continuation of application No. 16/258,132, filed on Jan. 25, 2019, now Pat. No. 11,330,853.

(60) Provisional application No. 62/627,047, filed on Feb. 6, 2018.

(51) Int. Cl.

| | |
|---|---|
| ***A41D 15/00*** | (2006.01) |
| ***A41D 3/00*** | (2006.01) |
| ***A41D 27/20*** | (2006.01) |

(52) U.S. Cl.

CPC ..... *A41D 15/00* (2013.01); *A41D 3/00* (2013.01); *A41D 3/005* (2013.01); *A41D 27/20* (2013.01); *A41D 15/005* (2013.01); *A41D 2200/20* (2013.01); *A41D 2300/322* (2013.01);

(Continued)

(58) Field of Classification Search

CPC ..... A41D 15/00; A41D 3/00; A41D 2200/20; A41D 2300/322; A41D 2300/33; A41D 2400/424; A41D 2400/44

See application file for complete search history.

(56) References Cited

U.S. PATENT DOCUMENTS

| | | | |
|---|---|---|---|
| 302,901 | A | 8/1884 | Fenne |
| 697,576 | A | 4/1902 | Brockert |
| 1,479,854 | A | 1/1924 | Heller |

(Continued)

FOREIGN PATENT DOCUMENTS

| | | | |
|---|---|---|---|
| CN | 103096743 | A | 5/2013 |
| CN | 202950041 | U | 5/2013 |

(Continued)

OTHER PUBLICATIONS

Allroad Motorcycle Jackets, Pants and Riding Suits, Allroad MC Touring, allroadendurotouring.com, Available online at: <https://allroadendurotouring.com/allroad-riding-gear-apparel/allroad-riding-suits-jackets-and-pants/>, Accessed on Jul. 2015, 6 pages.

(Continued)

*Primary Examiner* — Richale L Quinn

(74) *Attorney, Agent, or Firm* — Shook, Hardy & Bacon L.L.P.

(57) ABSTRACT

Aspects herein provide methods of transforming a stowable article of apparel for an upper torso of a wearer. The article of apparel comprises a first tensioning mechanism superior to and parallel with a waist opening, and a second tensioning mechanism coincident with the waist opening and spaced apart from the first tensioning mechanism. An upper half of the article of apparel is doffed. The waist opening is folded upward toward the first tensioning mechanism forming a pouch between the first and second tensioning mechanisms where the upper half of the article of apparel is stowed. The second tensioning mechanism is tensioned, thereby stowing the article of apparel in the pouch around the wearer.

20 Claims, 15 Drawing Sheets

(52) U.S. Cl.
CPC .... *A41D 2300/33* (2013.01); *A41D 2400/424* (2013.01); *A41D 2400/44* (2013.01)

(56) References Cited

U.S. PATENT DOCUMENTS

| | | | |
|---|---|---|---|
| 1,706,097 | A | 3/1929 | Edgar |
| 1,804,930 | A | 5/1931 | Head et al. |
| 2,292,347 | A | 8/1942 | Bailey |
| 2,314,433 | A | 3/1943 | Rene |
| 2,485,511 | A | 10/1949 | Riggs |
| 2,622,248 | A | 12/1952 | Schaye |
| 2,697,224 | A | 12/1954 | Harry |
| 2,729,410 | A | 1/1956 | Moran |
| 3,041,625 | A | 7/1962 | Joseph |
| 3,045,243 | A | 7/1962 | Seymour et al. |
| 3,067,476 | A | 12/1962 | Otto et al. |
| 3,323,136 | A | 6/1967 | Frederick |
| 3,389,407 | A | 6/1968 | Morrison |
| 3,670,340 | A | 6/1972 | Walker |
| 3,731,319 | A | 5/1973 | O'Neill |
| 4,055,852 | A | 11/1977 | Wallace |
| 4,158,892 | A | 6/1979 | Gonzales |
| 4,351,066 | A | 9/1982 | Pearsall |
| 4,370,755 | A | 2/1983 | Crumby |
| 4,476,587 | A | 10/1984 | Itoi |
| D277,048 | S | 1/1985 | Peyser |
| D277,049 | S | 1/1985 | Peyser |
| 4,523,703 | A | 6/1985 | Mckenna |
| 4,718,122 | A | 1/1988 | Steverson |
| 4,792,040 | A | 12/1988 | Wagstaff, III |
| 4,944,042 | A | 7/1990 | Dewan |
| 5,077,838 | A | 1/1992 | Senser |
| 5,097,536 | A | 3/1992 | Cohen |
| 5,119,510 | A | 6/1992 | Schilling |
| 5,331,685 | A | 7/1994 | Belgard |
| 5,452,476 | A | 9/1995 | Jenks |
| 5,509,147 | A | 4/1996 | Busquets |
| 5,533,210 | A | 7/1996 | Maderek et al. |
| 5,564,125 | A | 10/1996 | Waldman et al. |
| 5,787,504 | A | 8/1998 | Wu |
| 5,802,609 | A | 9/1998 | Garofalo |
| 5,829,059 | A | 11/1998 | Covington, Jr. |
| 5,860,164 | A | 1/1999 | Johnson |
| 5,940,879 | A | 8/1999 | Whitehouse |
| D414,013 | S | 9/1999 | Group |
| 6,061,831 | A | 5/2000 | Rudolph et al. |
| 6,108,815 | A | 8/2000 | Majerfeld |
| 6,115,840 | A | 9/2000 | Hastings |
| 6,125,472 | A | 10/2000 | Nakagawa |
| D439,029 | S | 3/2001 | Goldman |
| 6,332,222 | B1 | 12/2001 | Graham |
| 6,360,370 | B1 | 3/2002 | Ferreras |
| 6,370,692 | B1 | 4/2002 | Duyn et al. |
| 6,385,775 | B1 | 5/2002 | Komjati |
| 6,405,377 | B1 | 6/2002 | Davis |
| 6,415,440 | B1 | 7/2002 | Stinton |
| 6,564,388 | B1 | 5/2003 | Poston |
| 6,658,665 | B2 | 12/2003 | Dodge |
| 6,715,160 | B2 | 4/2004 | Crye et al. |
| 6,981,282 | B2 | 1/2006 | Marty et al. |
| 6,996,850 | B2 | 2/2006 | Tanaka |
| 7,000,255 | B1 | 2/2006 | Baacke |
| 7,143,450 | B2 | 12/2006 | Green, III |
| 7,152,247 | B2 | 12/2006 | Parsons |
| 7,296,303 | B1 | 11/2007 | Samet |
| 7,374,071 | B2 | 5/2008 | Lavelle |
| 7,395,555 | B2 | 7/2008 | Aldridge et al. |
| 7,647,656 | B2 | 1/2010 | Smith |
| 7,673,348 | B2 | 3/2010 | Williams |
| 7,770,234 | B2 | 8/2010 | Roux et al. |
| D677,859 | S | 3/2013 | Andes |
| 8,402,562 | B1 | 3/2013 | Seddiki |
| 8,429,763 | B2 | 4/2013 | Hawbaker |
| D688,849 | S | 9/2013 | Kochling |
| 8,522,369 | B2 | 9/2013 | Bay |
| 8,561,212 | B2 | 10/2013 | Saotome |
| D733,400 | S | 7/2015 | Cunningham |
| 9,119,428 | B2 | 9/2015 | Kuelker |
| 9,456,642 | B2 | 10/2016 | Lee |
| 9,557,139 | B1 | 1/2017 | Miner et al. |
| 10,231,496 | B1 | 3/2019 | Glassner |
| 10,306,955 | B2 | 6/2019 | Ressler |
| 10,433,600 | B2 | 10/2019 | Emoff |
| 2003/0070211 | A1 | 4/2003 | Crye et al. |
| 2004/0055069 | A1 | 3/2004 | Clarke et al. |
| 2004/0172734 | A1 | 9/2004 | Hartbrodt |
| 2006/0218690 | A1 | 10/2006 | James |
| 2007/0083983 | A1 | 4/2007 | Barclay |
| 2008/0155797 | A1 | 7/2008 | Tamura |
| 2008/0271222 | A1 | 11/2008 | Nienow |
| 2008/0301861 | A1 | 12/2008 | Meistrell et al. |
| 2009/0205096 | A1 | 8/2009 | Seemann |
| 2009/0241235 | A1 | 10/2009 | Weinreb |
| 2012/0060256 | A1 | 3/2012 | Parker |
| 2012/0060260 | A1 | 3/2012 | Kochling |
| 2013/0019378 | A1 | 1/2013 | White |
| 2013/0212772 | A1 | 8/2013 | Apostoloff |
| 2014/0026289 | A1 | 1/2014 | Schulties |
| 2014/0196188 | A1 | 7/2014 | Brady |
| 2014/0345029 | A1 | 11/2014 | Saladino |
| 2014/0373246 | A1 | 12/2014 | Chapuis |
| 2015/0020288 | A1 | 1/2015 | Picot |
| 2016/0073716 | A1 | 3/2016 | Short |
| 2016/0316832 | A1 | 11/2016 | Straughan |
| 2017/0006937 | A1 | 1/2017 | Wu |
| 2019/0239582 | A1 | 8/2019 | Koshkaroff |

FOREIGN PATENT DOCUMENTS

| | | | |
|---|---|---|---|
| CN | 203897354 | U | 10/2014 |
| CN | 104605560 | A | 5/2015 |
| CN | 206586439 | U | 10/2017 |
| CN | 107660125 | A | 2/2018 |
| DE | 8805269 | U1 | 6/1988 |
| DE | 202006003077 | U1 | 8/2006 |
| FR | 2557435 | A1 | 7/1985 |
| FR | 2914824 | A1 | 10/2008 |
| GB | 2253776 | A | 9/1992 |
| GB | 2388766 | A | 11/2003 |
| GB | 2455120 | A | 6/2009 |
| GB | 2494142 | A | 3/2013 |
| JP | 2001226806 | A | 8/2001 |
| NO | 20030859 | | 2/2003 |
| TW | 413620 | B | 12/2000 |
| WO | 2008/121106 | A1 | 10/2008 |
| WO | 2012/001602 | A1 | 1/2012 |
| WO | 2012/062950 | A1 | 5/2012 |

OTHER PUBLICATIONS

Beuchat Med C-Zip—Overall 8/7 mm Wetsuit with Chest-Zip and Hood-Attached, Beuchat, divestock.com, Available online at: <https://www.divestock.us/beuchat-med-c-zip-overall-8-7-mm-wetsuit-with-chest-zip-and-hood-attached>, Accessed on Nov. 3, 2017, 2 pages.

Black Horizontal Zipper Sweatshirt, thehunt.com. Available online at: <thtps://www.thehunt.com/the-hunt/SCxYW5-black-horizontal-zipper-sweatshirt->, Accessed on Nov. 3, 2017, 3 pages.

Cotton Neon Detail Maternity & Nursing Sweater, Seraphine, seraphine.com, Available online at:<https://web.archive. org/web/20171104070754/http://www.seraphine.com/us/cotton-neon-detail-maternity-nursingsweater.html>, Accessed on Apr. 11, 2017, 7 pages.

Foldable Waist Fanny Pack Poncho, Premium Industries, premiumindustries.com, Product ID: 6785905, http://www.premiumindustries.com/cre00024/foldable-waist-fanny-pack-poncho.html, 2014, 1 page.

H20 Operations Drysuit, DUI, divedui.com, Available online at: <https://www.divedui.com/products/h20-operations-public-safety-premium-drysuit>, Accessed on Nov. 3, 2017, 4 pages.

Hollis Neotek Semi-Drysuit, Hollis, decadiving com, Available online at: <https://web.archive.org/web/20171103202841 /https://decadiving.com/product/hollis-neotek-semi-drysuit/>, Nov. 3, 2011.

(56) References Cited

OTHER PUBLICATIONS

John Boultbee Oxford Rain Cape, John Boultbee, Brooks England, Available online at: <https://www.brooksengland.com/en_us/blog/john-boultbee-oxford-rain-cape.html>, Jan. 7, 2011, 6 pages.
Men's Verto Pro Jacket, The North Face, thenorthface.com, Available online at:<http://www.thenorthface.com/catalog/sc-gear/men-39-s-verto-pro-jacket.html>, 2013, 5 pages.
Outdoor Products Multi-Purpose Poncho, REI—Recreational Equipment, rei.com, Item# 743067,Available online at: <http://www.rei.com/producl/743067/outdoor-products-multi-purpose-poncho>, 2014, 1 page.
Protest Charger Packaway Jacket Army Green, RinSkies, rinskis.com, Product code: 7648, Available online at: <http://rinskis.com/protest-charger-packaway-jacket-army-green.html>, 2014, 3 pages.
Rev'It! Cayenne Jacket Review, Web Bike World®, webbikeworld.com, Available online at: <http://www.webbikeworld.com/r3/revit/revit-cayenne-jacket htm>, Aug. 2005, 20 pages.
Salomon Men's Fast Wing Hoodie, REI Co-op, Item #894285, Available online at: <https://www.rei.com/product/894285/salomon-fast-wing-hoodie-mens>, 2016, 7 pages.
SolAfx, Aqua Lung, aqualung.com, Available online at: <http://www.aqualung.com/us/divegear/wetsuits/solafx>, Jun. 30, 2017, 1 page.
Sportful Survival Gore Tex Winter Jacket, Wiggle, wiggle.co.uk, Available online at: <http://www.wiggle.co.uk/sportful-survival-goretex-winter-jacket/>, 2015, 4 pages.
Why Rain Capes Are Awesome, Clever Cycles, clevercycles.com, Available online at: <http://clevercycles.com/blog/2013/09/26/why-rain-capes-are-awesome/>, Sep. 26, 2018, 2 pages.
Pierotti, Lyra, "Marmot PreCip—Women's Review", Outdoorgearlab.com,Available online at: <http://www.outdoorgearlab.com/Rain-Jacket-Womens-Reviews/Marmot-PreCip-Womens>, Oct. 16, 2014, 9 pages.

STOWABLE ARTICLE OF APPAREL AND APPAREL SYSTEM

CROSS-REFERENCE TO RELATED APPLICATIONS

This application, having been assigned U.S. application Ser. No. 17/716,759, is a continuation of U.S. patent application Ser. No. 16/258,132, filed Jan. 25, 2019, entitled "Stowable Article of Apparel and Apparel System," issued on May 17, 2022 as U.S. Pat. No. 11,330,853, which claims the benefit of priority of U.S. Provisional Application No. 62/627,047, filed Feb. 6, 2018, and entitled "Stowable Article of Apparel and Apparel System." The entireties of the aforementioned applications are expressly incorporated by reference herein.

TECHNICAL FIELD

Aspects herein relate to a stowable article of apparel and apparel system for easy donning and doffing during activity.

BACKGROUND

Conventional jackets are difficult to don and doff during activities, such as walking or running, and generally have no area to stow the jacket after doffing.

BRIEF DESCRIPTION OF THE DRAWINGS

Examples of the present article of apparel and apparel system are described in detail below with reference to the attached drawing figures, wherein.

DETAILED DESCRIPTION

Figure 1:
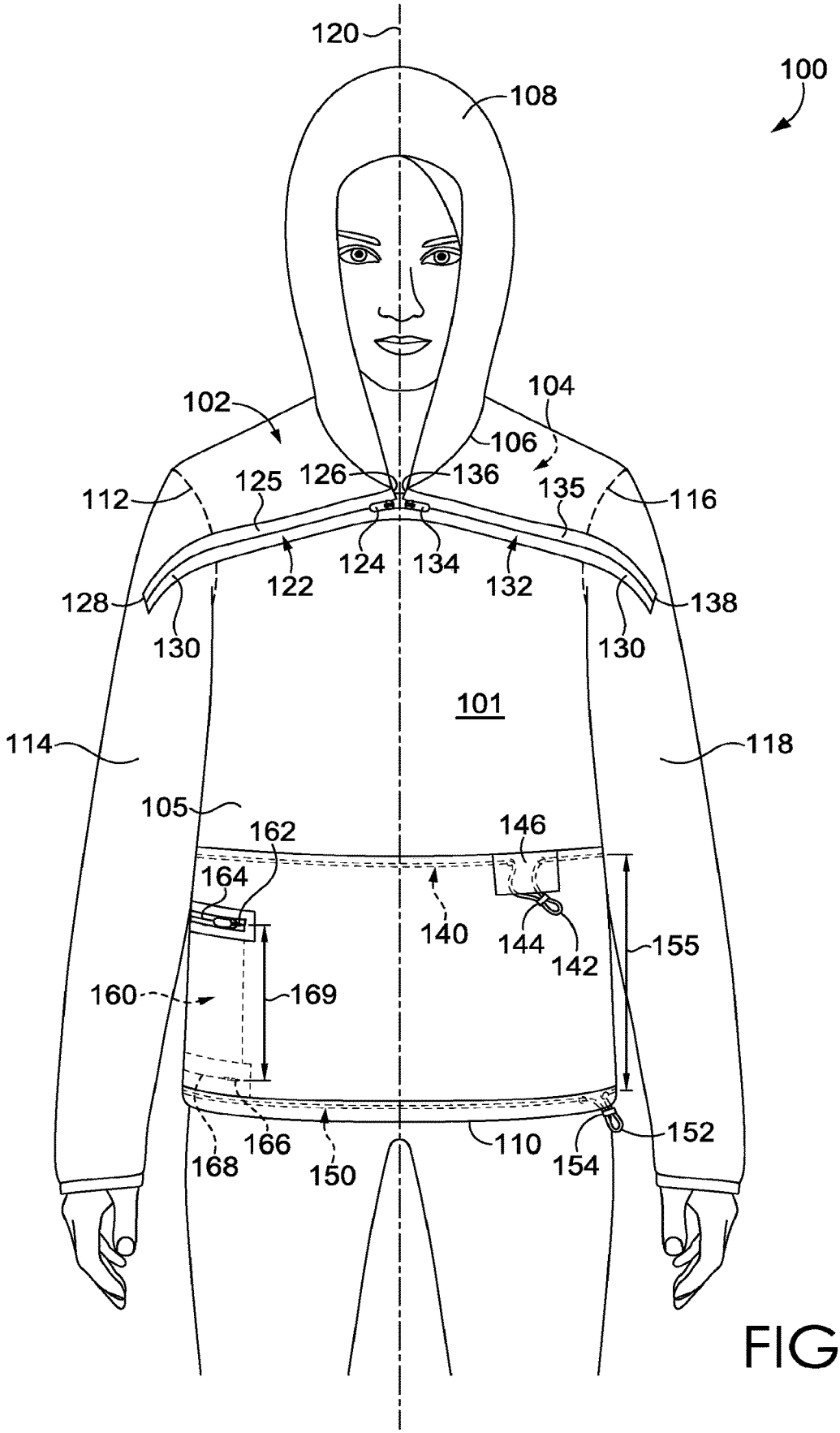
FIG. 1 illustrates a front view of an exemplary upper-body article of apparel having exemplary slider mechanisms for easy donning and doffing and an exemplary storage mechanism, in accordance with aspects described herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein relate to an article of apparel and apparel system for an upper-body that can easily be donned and doffed during activity. In some aspects, the articles of apparel and apparel systems are stowable about a waist area of a wearer. In exemplary aspects, an article of apparel and/or apparel system comprises a first and second slider mechanism on an upper part of a torso portion. The slider mechanisms are configured to transition from a closed state to an open state by moving respective slider pulls away from a vertical midline of the article of apparel and/or apparel system toward respective sleeves of the article of apparel and/or apparel system. This movement enables the upper back aspect of the article of apparel and/or apparel system to be folded down in the back, and the upper front aspect of the article of apparel and/or apparel system to be folded down in the front, thus allowing for easy donning and doffing of the article of apparel or apparel system. In some exemplary aspects, the article of apparel and/or apparel system may comprise one or more tensioning mechanisms on the lower part of the torso portion. In some aspects, the one or more tensioning mechanisms are used to facilitate securing the article of apparel or apparel system to the wearer after the article of apparel and/or apparel system has been doffed as described above. In some aspects, the one or more tensioning mechanisms are further used to facilitate stowing the article of apparel or apparel system around the waist area of the wearer. In some aspects, the article of apparel or apparel system has one or more pockets that may have one or more of an inner opening, an outer opening, or both. In exemplary aspects having the one or more pockets, the pockets may be located on an upper part or lower part of the article of apparel or apparel system. The pockets are configured to allow for use when the article of apparel is both donned and doffed.

Accordingly, one aspect is directed to an article of apparel for an upper torso of a wearer. The article of apparel comprises a torso portion comprising a front aspect and a back aspect that together define at least a neckline opening, a waist opening, a first arm opening, and a second arm opening. The article of apparel also comprises a first sleeve extending from the first arm opening and a second sleeve extending from the second arm opening. The article of apparel also comprises a first tensioning mechanism extending circumferentially around the torso portion and affixed thereto, the first tensioning mechanism positioned parallel to the waist opening; and a second tensioning mechanism extending circumferentially around the torso portion and affixed thereto, the second tensioning mechanism positioned inferior and parallel to the first tensioning mechanism, the second tensioning mechanism spaced apart from the first tensioning mechanism by a predetermined distance. The article of apparel also comprises a first slider mechanism with a first slider pull, the first slider mechanism having a first stop and a second stop, the first stop positioned inferior to the neckline opening at a front midline of the article, the second stop positioned adjacent to the first arm opening, where the first slider mechanism is transitioned from a closed position to an open position by moving the first slider pull away from the neckline opening and toward the first arm opening; and a second slider mechanism with a second slider pull, the second slider mechanism having a third stop and a fourth stop, the third stop positioned inferior to the neckline opening at the front midline of the article, the fourth stop positioned adjacent to the second arm opening, where the second slider mechanism is transitioned from a closed position to an open position by moving the second slider pull away from the neckline opening and toward the second arm opening.

Another aspect provides for an apparel system for an upper torso of a wearer. The apparel system comprises an inner article comprising at least a torso portion having a front aspect and a back aspect that together define at least a first neckline opening, a first waist opening, a first arm opening, and a second arm opening. The apparel system also comprises an outer article positioned external to the inner article and affixed to the inner article at one or more locations. The outer article comprises at least a torso portion having an interior aspect and an exterior aspect, and having a front aspect and a back aspect, the front aspect and the back aspect together defining at least a second neckline opening, a second waist opening, a third arm opening, and a fourth arm opening, a first sleeve extending from the third arm opening and a second sleeve extending from the fourth arm opening. The outer article also comprises at least a first slider mechanism with a first slider pull, the first slider mechanism having a first stop and a second stop, the first stop positioned inferior to the second neckline opening at a front midline of the outer article, the second stop positioned adjacent to the third arm opening, where the first slider mechanism is transitioned from a closed position to an open position by moving the first slider pull away from the second neckline opening and toward the third arm opening; and a second slider mechanism with a second slider pull, the second slider mechanism having a third stop and a fourth stop, the third stop positioned inferior to the second neckline opening at the front midline of the outer article, the fourth stop positioned adjacent to the fourth arm opening, where the second slider mechanism is transitioned from a closed position to an open position by moving the second slider pull away from the second neckline opening and toward the fourth arm opening.

Yet another aspect provides for an article of apparel for an upper torso of a wearer. The article of apparel comprises a torso portion having a front aspect and a back aspect that together define at least a neckline opening, a waist opening, a first arm opening, and a second arm opening. The article of apparel also comprises a first sleeve extending from the first arm opening and a second sleeve extending from the second arm opening. The article of apparel further comprises a first slider mechanism with a first slider pull, the first slider mechanism having a first stop and a second stop, the first stop positioned inferior to the neckline opening at a front midline of the article, the second stop positioned adjacent to the first arm opening, where the first slider mechanism is transitioned from a closed position to an open position by moving the first slider pull away from the neckline opening and toward the first arm opening; and a second slider mechanism with a second slider pull, the second slider mechanism having a third stop and a fourth stop, the third stop positioned inferior to the neckline opening at the front midline of the article, the fourth stop positioned adjacent to the second arm opening, where the second slider mechanism is transitioned from a closed position to an open position by moving the second slider pull away from the neckline opening and toward the second arm opening. The article of apparel further comprises a tensioning mechanism extending circumferentially around the torso portion and affixed thereto, the tensioning mechanism positioned superior to and parallel to the waist opening and spaced apart from the waist opening by a predetermined distance.

While another example aspect provides for an article of apparel for an upper torso of a wearer. The article of apparel comprises a torso portion comprising a front aspect and a back aspect that together define at least a neckline opening, a waist opening, a first arm opening, and a second arm opening. The article of apparel also comprises a slider mechanism extending horizontally across the front aspect of the torso portion from a first end adjacent to the first arm opening to a second end adjacent to the second arm opening. The slider mechanism is positioned inferior to and adjacent to the neckline opening. A first state of the slider mechanism comprises an open position and a second state of the slider mechanism comprises a closed position. The article of apparel also comprises a first tensioning mechanism extending circumferentially around the torso portion and affixed thereto. The first tensioning mechanism is positioned parallel to the waist opening and inferior to the slider mechanism. The article of apparel also comprises a second tensioning mechanism extending circumferentially around the torso portion and affixed thereto. The second tensioning mechanism is positioned parallel to the waist opening and inferior to the first tensioning mechanism. An upper part of the torso portion is positioned superior to the first tensioning mechanism and a lower part of the torso portion is positioned inferior to the first tensioning mechanism. The upper part of the torso portion is adapted to be stowed in a pouch formed from the lower part of the torso portion and the first tensioning mechanism.

As used throughout this disclosure, positional terms used when describing, for instance, an article or portions of an article, such as "anterior," "posterior," "inferior," "superior," "lateral," "medial," "superior," "upper," "lower," "front," "back," and the like are to be given their common meaning with respect to the article being worn as intended by a hypothetical wearer standing in anatomical position. Unless indicated otherwise, terms such as "affixed," "coupled," "secured," and the like may mean releasably affixing two or more elements together using for instance, structural differences between the elements, releasable adhesives, snaps, buttons, hook-and-loop fasteners, and the like. These terms may also mean permanently affixing two or more elements together using, for example, stitching, bonding, adhesives, welding, and the like.

Also as used throughout this disclosure, the relative term "adjacent" means at or within about 0.1 mm to about 15 cm from one location relative to another. Further, the relative term "abut," as used herein, means physically touching or separated from about 0.1 mm to about 5 mm. What is meant by "about" here and throughout this disclosure is ±10%.

Additionally, when used herein, the term "closure mechanism" generally means any device or plurality of devices that may repeatedly fasten and unfasten. In some cases, closure mechanisms may be affixed to one or more pieces of a fabric or other flexible material to fasten and unfasten the material. Example closure mechanisms are snaps, buttons, hook-and-loop fasteners, slider mechanisms, and the like.

Also, as used herein, the term "slider mechanism" is a type of closure mechanism that generally means any device having a "slider pull" that may be used to repeatedly fasten and unfasten, based on the direction of the slider pull, a length of fabric or other flexible material. For example, one type of slider mechanism may be a zipper having a pull that closes a set of teeth when the pull is moved in one direction, thereby fastening a length of material separated by the set of teeth, and that unlocks the set of teeth when the pull is moved in an opposing direction, thereby unfastening the length of material separated by the set of teeth. In another example, the slider mechanism may comprise complementary hook-and-loop fasteners. In this example, the "slider pull" may comprise a tab or even a user's fingers. When tension is exerted on the slider pull in a specified direction, the hook component of the hook-and-loop fastener may be disengaged from the loop component of the hook-and-loop fastener. These are just examples, and other types of slider mechanisms are contemplated herein. In some cases, a slider mechanism may comprise a stop. As used herein, the term "stop" refers to a location of the slider mechanism beyond which a slider pull does not move.

Further, as used herein, the term "tensioning mechanism" generally means a device that can apply tension to a fabric or other flexible material. In some examples, a tensioning mechanism may comprise a "tensioning cord" and a "cord lock." For example, one type of tensioning mechanism may have a tensioning cord having two ends, where each end is slidably threaded through a cord lock, thus forming a loop with the tensioning cord and the cord lock. The cord lock may use friction between the tensioning cord and the cord lock to maintain a placement of the cord lock on the tensioning cord. In some aspects, the cord lock may use mechanical technology known in the art, for example a spring, to increase the applied friction. Thus, as one or both ends of the tensioning cord are pulled through the cord lock, the diameter of the loop may decrease, and based on the friction between the cord lock and the tensioning cord, the diameter of the loop may remain constant until the tensioning cord is threaded back through the cord lock in the opposite direction. As will be appreciated, when a tensioning mechanism, such as the example tensioning mechanism just described, is used in conjunction with a fabric or flexible material, the fabric or flexible material may have tension applied to it via the tensioning mechanism.

Turning now to FIG. 1, a front view of an example upper-body article of apparel 100 is provided in accordance with aspects described herein. In general, the article of apparel 100 may be made of any fabric or any combination of fabrics, natural or synthetic. For instance, some portions of the article of apparel 100 may be made of one type of fabric, while other portions may be made of another type of fabric. In some aspects, the article of apparel 100 is made of a woven material, which may be waterproof, water resistant, and/or wind resistant. In some cases, the fabric may be treated to create enhanced desirable properties. For example, the fabric may be treated with a durable water repellant (DWR). In some aspects, the woven materials and/or treated materials may provide protection to a wearer when exposed to inclement weather conditions, such as rain, snow, wind, fog, cold temperatures, and the like. It is also contemplated that the article of apparel 100 is made of a knit material or a non-woven material. Any and all aspects, and any variation thereof, are contemplated as being within aspects herein.

Figure 2:
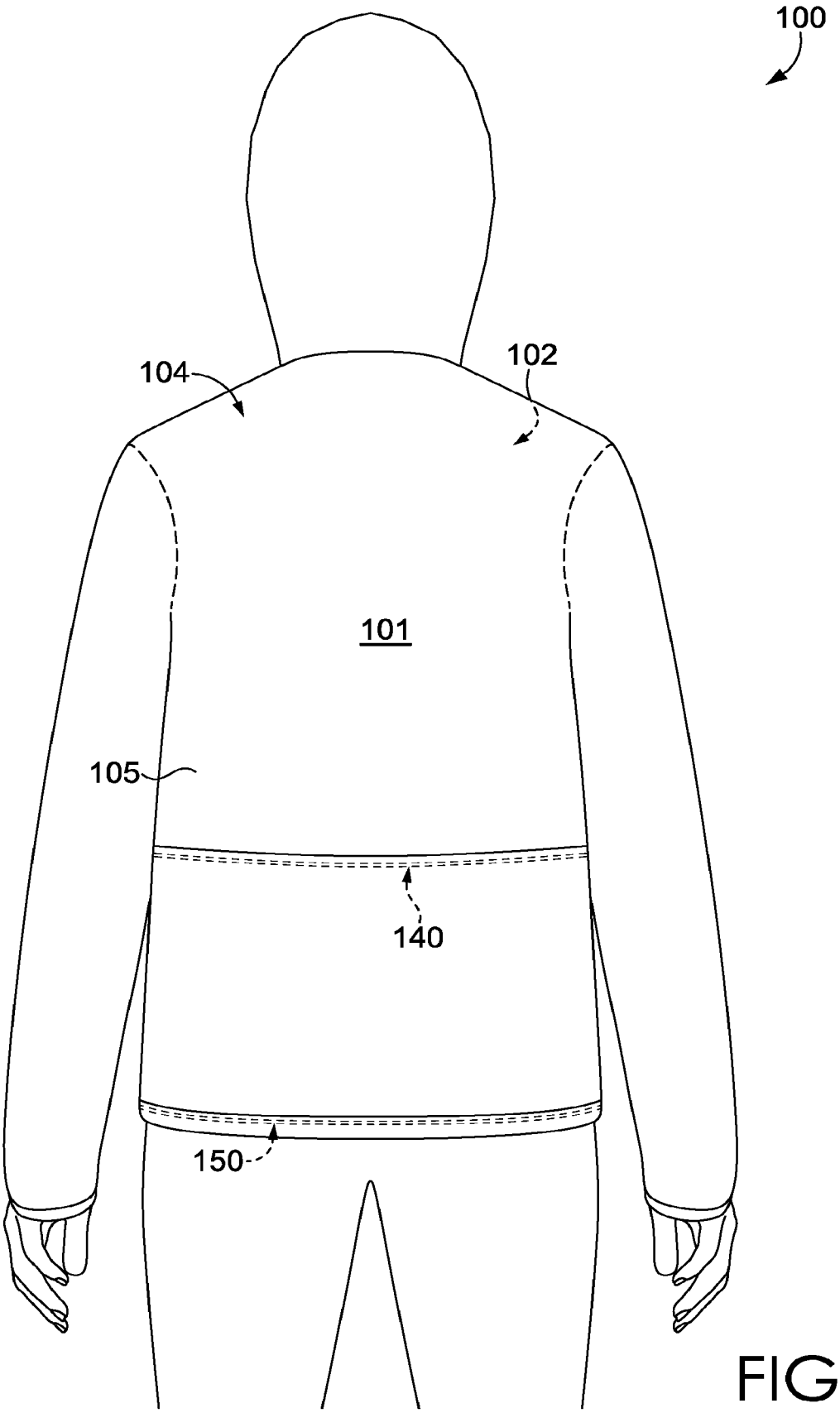
FIG. 2 illustrates a back view of the article of apparel of FIG. 1, in accordance with aspects described herein.

The article of apparel 100, as illustrated, comprises a torso portion 105 that has a front aspect 102 and a back aspect 104. Together the front aspect 102 and the back aspect 104 define a neckline opening 106 and a waist opening 110. In some aspects, such as the one illustrated in FIG. 1, a hood 108 may extend from the neckline opening 106. With brief reference to FIG. 2, a back view of the article of apparel 100 of FIG. 1 is provided to better show the back aspect 104 of the torso portion 105.

Figure 13:
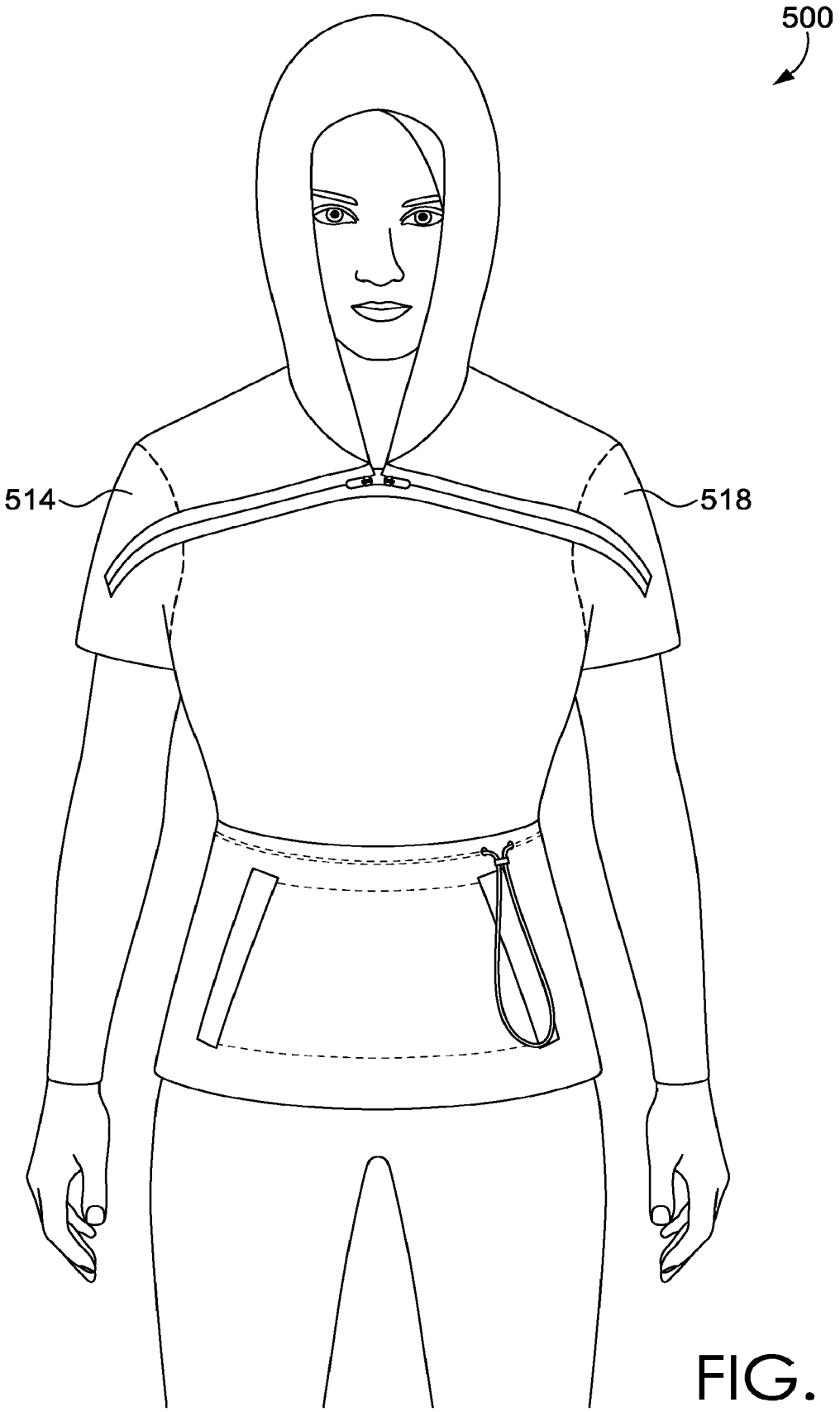
FIG. 13 illustrates an exemplary upper-body article of apparel having short sleeves, in accordance with aspects described herein.

Continuing with FIG. 1, the front aspect 102 and the back aspect 104 further define a first arm opening 112 and a second arm opening 116. As shown in FIG. 1, a first sleeve 114 extends from the first arm opening 112, and a second sleeve 118 extends from the second arm opening 116. Although the first sleeve 114 and the second sleeve 118 are shown as long sleeves, it is contemplated herein that the sleeves 114 and 118 may comprise short sleeves, mid-length sleeves, and even no sleeves. For example, see FIG. 13, which illustrates aspects of an exemplary upper-body article of apparel 500 having a short first sleeve 514 and a short second sleeve 518. Continuing again with FIG. 1, the first arm opening 112 and the second arm opening 116 are illustrated in FIG. 1 as dashed lines. However, it will be appreciated that, in some aspects, the dashed lines are theoretical in nature and illustrated here to assist in describing the present technology. Put another way, in some aspects, the torso portion 105 may extend seamlessly through to the first sleeve 114 and to the second sleeve 118 without physically delineating the torso portion 105 from the first sleeve 114 or the second sleeve 118. In some aspects, the arm openings 112 and 116 are seam lines that join the first sleeve 114 and the second sleeve 118 to the torso portion 105.

The example article of apparel 100 of FIG. 1 is also illustrated as having a first slider mechanism 122 and a second slider mechanism 132. The first slider mechanism 122 comprises a first slider pull 124, a first stop 126, and a second stop 128. As shown in FIG. 1, the first stop 126 is positioned inferior and adjacent to the neckline opening 106 near or at a vertical midline 120 of the article of apparel 100, while the second stop 128 is positioned adjacent to the first arm opening 112 and on the first sleeve 114. In some aspects, the second stop 128 is located on the first sleeve 114 from about 0.1 cm to about 30 cm from the first arm opening 112, which may be a seam line, as measured from the first arm opening 112 laterally toward the second stop 128. In some aspects, the second stop 128 may be from about 5 cm to about 25 cm, from about 10 cm to about 20 cm, from about 14 cm to about 16 cm, or about 15 cm from the first arm opening 112.

It will be understood that the vertical midline 120 is theoretical and is represented by a dashed line. The theoretical vertical midline 120 may generally be centrally located along the article of apparel 100 as measured from a first lateral side of the article of apparel 100 to a second opposite lateral side of the article of apparel 100, and extend vertically along the central location. What is meant by near the vertical midline 120 is that, in some aspects, the first stop 126 will be located generally at the vertical midline 120; or from about 0.1 mm to about 6 cm, from about 0.1 mm to about 5 cm, from about 0.1 mm to about 4 cm, from about 0.1 mm to about 3 cm, from about 0.1 mm to about 2 cm, or from about 0.1 mm to about 1 cm away from the vertical midline 120 as measured from the vertical midline 120 toward the first arm opening 112. In some aspects, the first slider mechanism 122 is transitioned from a closed position (shown in FIG. 1) to an open position (shown in FIG. 4) by moving the first slider pull 124 away from the neckline opening 106 and the vertical midline 120 and toward the first arm opening 112.

The second slider mechanism 132 of the article of apparel 100 is shown having a third stop 136 positioned inferior and adjacent to the neckline opening 106 near or at the vertical midline 120 as measured from the vertical midline 120 toward the second arm opening 116, and a fourth stop 138 positioned adjacent to the second arm opening 116 and on the second sleeve 118. In some aspects, the fourth stop 138 is located on the second sleeve 118 from about 0.1 cm to about 30 cm from the second arm opening 116, which may also be a seam line, as measured from the second arm opening 116 laterally toward the fourth stop 138. In some aspects, the fourth stop 138 may be from about 5 cm to about 25 cm, from about 10 cm to about 20 cm, from about 14 cm to about 16 cm, or about 15 cm from the second arm opening 116. In some cases, the second slider mechanism 132 is transitioned from the closed position (shown in FIG. 1) to an open position (shown in FIG. 4) by moving the second slider pull 134 away from the neckline opening 106 and the vertical midline 120 and toward the second arm opening 116.

Figure 4:
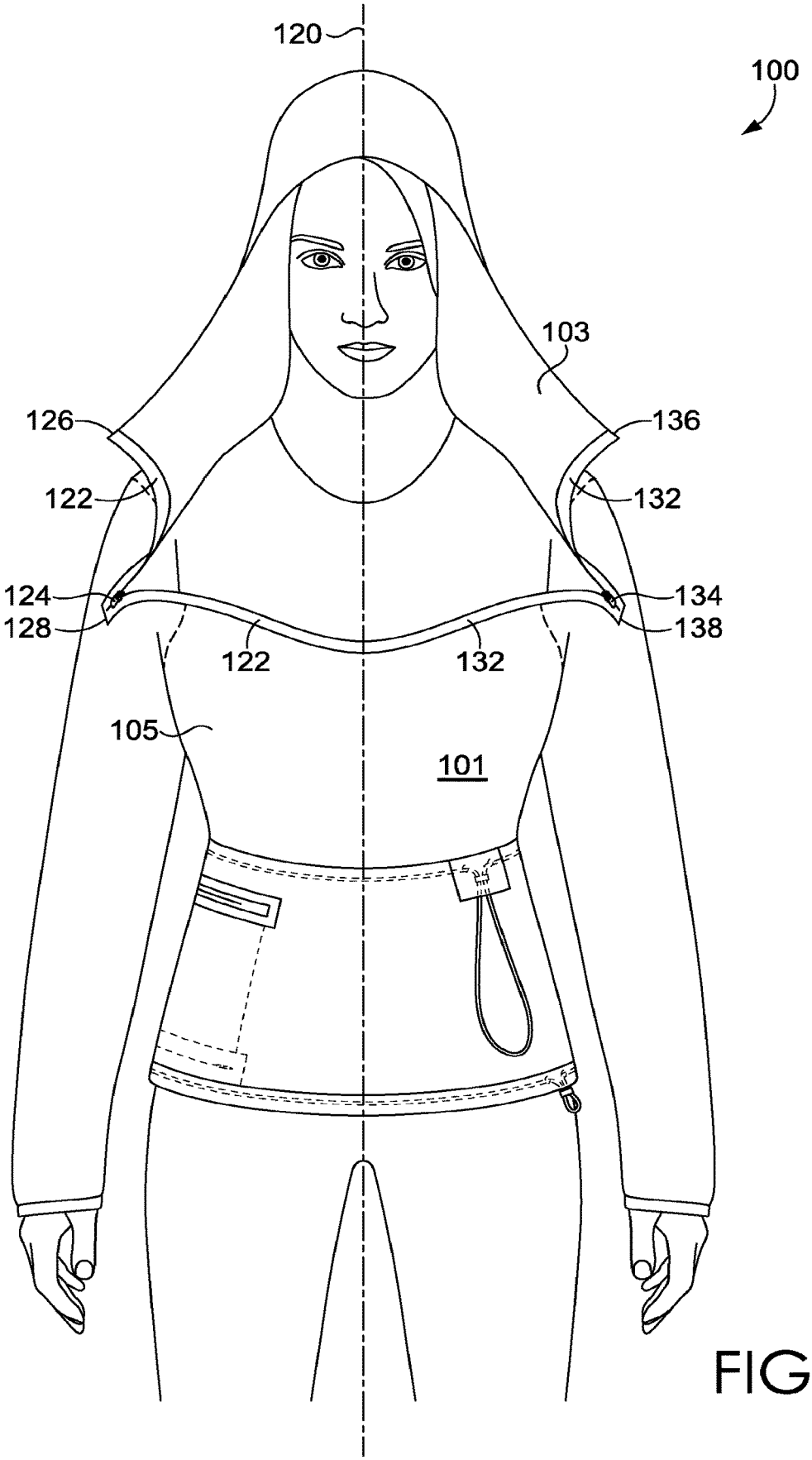

In some aspects, when in a closed position, the first slider pull 124 of the first slider mechanism 122 and the second slider pull 134 of the second slider mechanism 132 abut each other adjacent to and near the vertical midline 120. Turning to FIG. 4, another front view of the article of apparel 100 of FIG. 1 is illustrated. As shown in FIG. 4, the first slider mechanism 122 and the second slider mechanism 132 are in the open position. In some aspects, the open position may occur when the first slider pull 124 of the first slider mechanism 122 abuts the second stop 128 and when the second slider pull 134 of the second slider mechanism 132 abuts the fourth stop 138. While FIG. 1, and other aspects throughout this disclosure, is illustrated as having the first slider mechanism 122 and the second slider mechanism 132, it is contemplated that aspects of the article of apparel 100 may utilize other types of closure mechanisms in lieu of or in combination with the first slider mechanism 122 and the second slider mechanism 132.

In some aspects, the first slider mechanism 122 and the second slider mechanism 132 may be continuous, discontinuous, or a combination of both. FIG. 1 illustrates how a portion of the first slider mechanism 122 is continuous with respect to a portion of the second slider mechanism 132, while another portion of the first slider mechanism 122 is discontinuous with respect to another portion of the second slider mechanism 132. For example, a first slider tape 125 of the first slider mechanism 122 is discontinuous with respect to a second slider tape 135 of the second slider mechanism 132. Said another way, the first slider tape 125 and the second slider tape 135 are separated by one or more stops, in this case, the first stop 126 and the third stop 136. However, a portion of the first slider mechanism 122 is continuous with respect to a portion of the second slider mechanism 132 because they share a common slider tape 130 that extends continuously and without interruption from the second stop 128 to the fourth stop 138. It will be appreciated that, in some cases, which are not illustrated herein, a third slider tape and a fourth slider tape may be used in lieu of the common slider tape 130 illustrated in FIG. 1, so that the third slider tape and fourth slider tape are considered discontinuous. In such cases, the third slider tape may have a fifth stop that is positioned inferior to and in line with the first stop 126, while the fourth slider tape may have a sixth stop that is positioned inferior to and in line with the third stop 136. It is contemplated that, in some aspects, a slider mechanism may be continuous with respect to another slider mechanism when in a closed position, yet discontinuous in an open position.

With reference again to FIG. 4, the article of apparel 100 is illustrated as having an exterior aspect 101 and an interior aspect 103. The interior aspect 103 is closest to the wearer's body surface when the article of apparel 100 is fully donned and worn as intended, and the exterior aspect 101 is opposite the interior aspect 103 and is closest to the external environment when the article of apparel 100 is fully donned and worn as intended.

Figure 5:
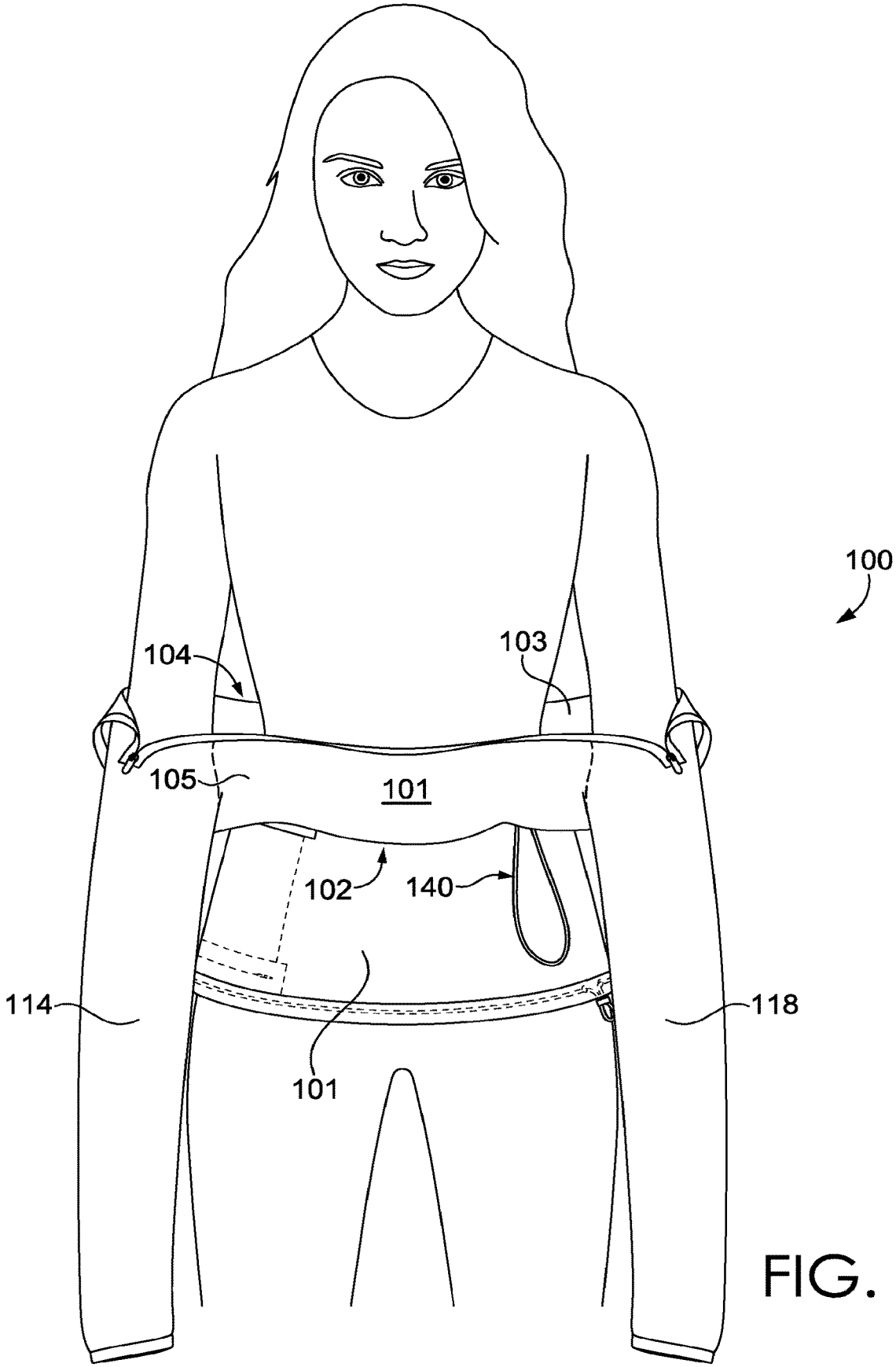

In the open position, the article of apparel 100 may be easily donned and doffed by a wearer. For example, when in the open position, the shoulder areas of the torso portion 105 may be folded rearward to the back of the wearer, as illustrated in FIG. 4. Further, when in the open position, the front aspect 102 of the article of apparel 100 may be folded downward along the front of the wearer. This allows at least a portion of the torso portion 105 to be moved downward around the wearer's waist so the wearer may doff the article of apparel 100. FIG. 5 illustrates another view of the article of apparel 100 of FIG. 1 as it is being moved downward and doffed by the wearer. As shown, the front aspect 102 is moved downward across a front side of the wearer, while the back aspect 104 is being moved downward across a backside of the wearer. As well, the sleeves 114 and 118 are configured to move downward so that the wearer can disengage her arms from the sleeves 114 and 118. Thus, at least a portion of the article of apparel 100 is easily doffed in this manner. It will be appreciated that a similar, but opposite, movement of the article of apparel 100 may be done to don the article of apparel 100, for example, by moving the front aspect 102 upward across the front side of the wearer, the back aspect 104 upward across the backside of the wearer, and the sleeves 114 and 118 up the arms of the wearer, and returning the first slider mechanism 122 and the second slider mechanism 132 to the closed position Continuing again with reference to FIG. 1, as illustrated, the article of apparel 100 includes a first tensioning mechanism 140 that extends circumferentially around the torso portion 105 and is slidably affixed to the article of apparel 100. In exemplary aspects, the first tensioning mechanism 140 is positioned parallel to the waist opening 110 and is spaced apart from the waist opening 110 by a predetermined distance as will be discussed. The first tensioning mechanism 140 comprises a first tensioning cord 142 and a first cord lock 144. In exemplary aspects, the first tensioning mechanism 140 may be affixed to the article of apparel 100 by enclosing at least a portion of the first tensioning cord 142 within a tunnel structure formed from the material of the article of apparel 100. However, it is contemplated herein that the first tensioning cord 142 may be affixed to the article of apparel 100 by other mechanisms, such as stitching, loops, and the like. In any case, by extending circumferentially around the torso portion 105, the first tensioning mechanism 140 is configured to apply circumferential tension to the torso portion 105 of the article of apparel 100. In exemplary aspects, access to the first tensioning cord 142 is provided at the front aspect 102 of the article of apparel 100. As illustrated in FIG. 1, the article of apparel 100 may comprise a flap 146 that may be used to cover the first tensioning cord 142 and the first cord lock 144.

Additionally, the article of apparel 100, as illustrated in FIG. 1, includes an optional second tensioning mechanism 150 that extends circumferentially around the torso portion 105 and is slidably affixed to the article of apparel 100 (e.g., by a tunnel structure or other similar mechanism) so that the second tensioning mechanism 150 may apply circumferential tension to the article of apparel 100 at the area of affixation. In some aspects, the second tensioning mechanism 150 is coincident with or aligned with the waist opening 110. In some aspects, the second tensioning mechanism 150 may be positioned inferior and parallel to the first tensioning mechanism 140 and may be spaced apart from the first tensioning mechanism 140 by a first predetermined distance 155. In some aspects, the first predetermined 155 distance is from about 10 cm to about 50 cm, from about 10 cm to about 40 cm, from about 10 cm to about 30 cm, from about 12 cm to about 28 cm, from about 14 cm to about 26 cm, from about 16 cm to about 24 cm, from about 20 cm to about 30 cm, from about 23 cm to about 30 cm, or from about 25 cm to about 30 cm. As shown in FIG. 1, the second tensioning mechanism 150 may comprise a second tensioning cord 152 and a second cord lock 154, and access to the second tensioning cord 152 and the second cord lock 154 may also be provided at the front aspect 102 of the article of apparel 100.

Figure 3:
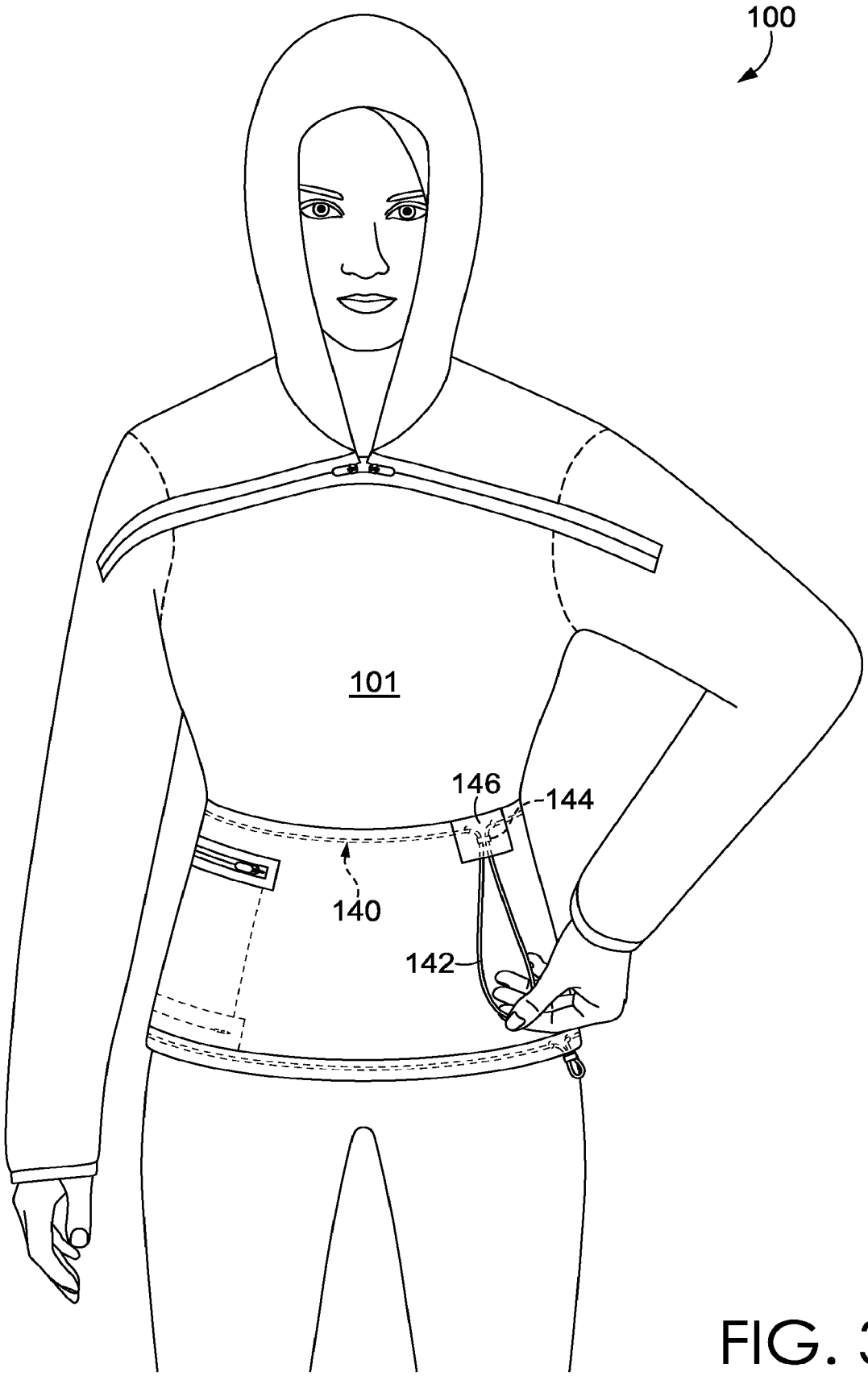
FIGS. 3-7 illustrate an exemplary method of doffing and storing the article of apparel of FIG. 1, in accordance with aspects described herein.

In some aspects, the first tensioning mechanism 140 and the second tensioning mechanism 150, together with at least a lower segment of the torso portion 105 of the article of apparel 100 extending between the first tensioning mechanism 140 and the second tensioning mechanism 150, may form a pouch for stowing at least a portion of the article of apparel 100. Turning now to FIG. 3, to stow at least a portion of the article of apparel 100, the first tensioning mechanism 140 may be adjusted to apply circumferential tension to the article of apparel 100 and the waist area of the wearer when the article of apparel 100 is worn. By applying circumferential tension to the article of apparel 100, the article of apparel 100 is better secured to the waist of the wearer so that it has less chance of falling off when doffed, making it less likely to trip or impede the wearer during activity. As illustrated in FIG. 3, the wearer is utilizing the first tensioning mechanism 140 by tightening the first tensioning cord 142 to reduce the loop size of the first tensioning cord 142 around the waist of the wearer, and securing the tension by adjusting the first cord lock 144 to frictionally hold the first tensioning cord 142 into position.

Figure 6:
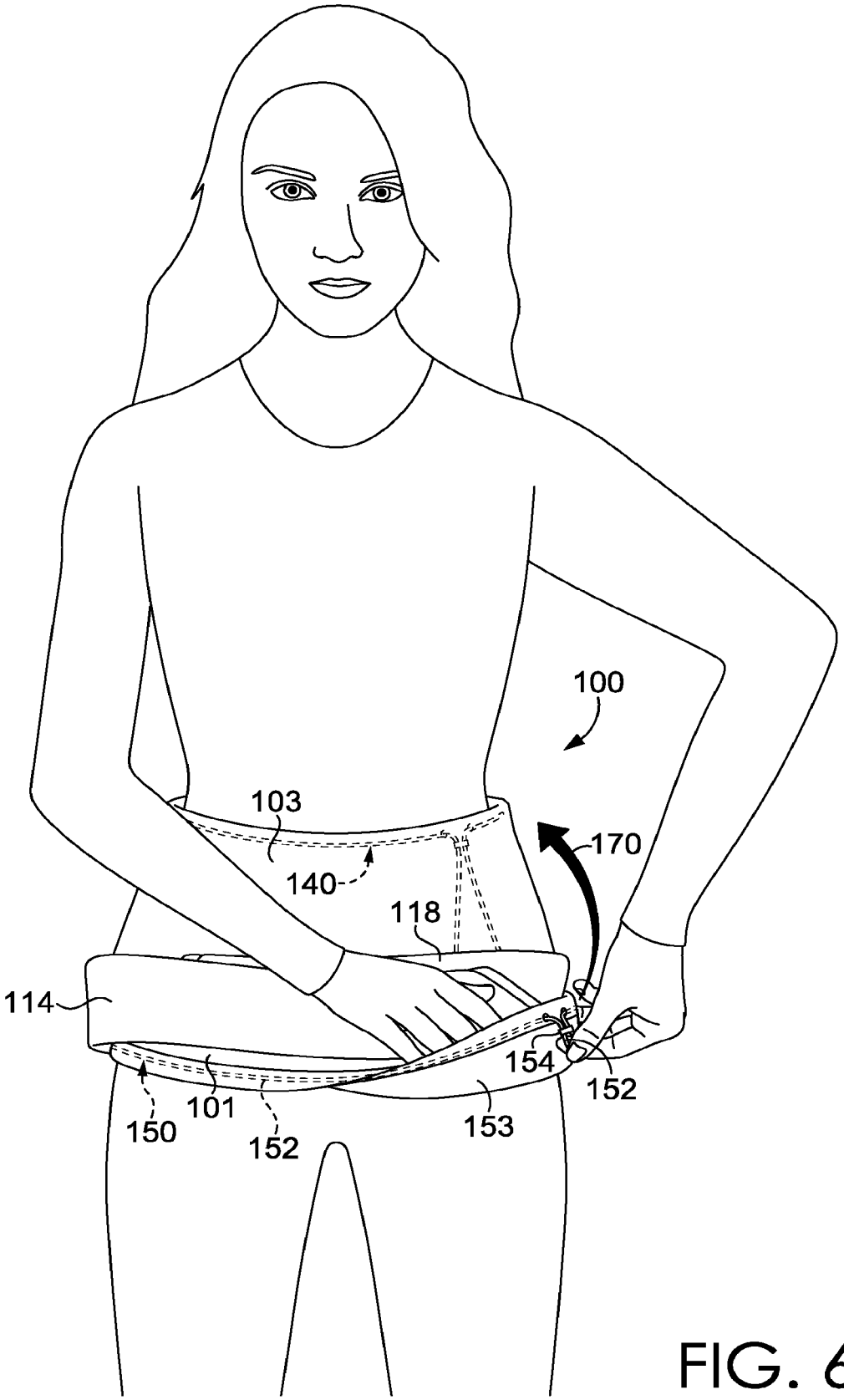

To stow at least the upper half of the article of apparel 100, as previously described in connection with FIG. 4 and FIG. 5, the wearer may doff the upper half of the article of apparel 100 by moving it downward to a point where it is stopped by the circumferential tension of the first tensioning mechanism 140, as illustrated in FIG. 6. What is meant by "upper half" is the part of the torso portion 105 that is generally above the first tensioning mechanism 140, while a "lower half" of the torso portion 105 is generally the part of the torso portion 105 that is below the first tensioning mechanism 140. Once moved downward, the upper half of the article of apparel 100, including the sleeves 114 and 118, is generally free of or disengaged from the wearer's body. This position is best illustrated by FIG. 6. As indicated by arrow 170, the second tensioning mechanism 150 may be moved or "flipped" upward so that the doffed portion of the torso portion 105 and the sleeves 114 and 118 are captured in a space between the first tensioning mechanism 140 and the second tensioning mechanism 150. For example, the second tensioning mechanism 150 may be moved upward so that it is positioned slightly above, at, or slightly below the first tensioning mechanism 140. As the second tensioning mechanism 150 is moved upward, the interior aspect 103 of the lower portion of the article of apparel 100 becomes outward-facing, as the external aspect 101 is folded back onto itself forming a pouch that stores the upper half of the article of apparel 100.

Figure 7:
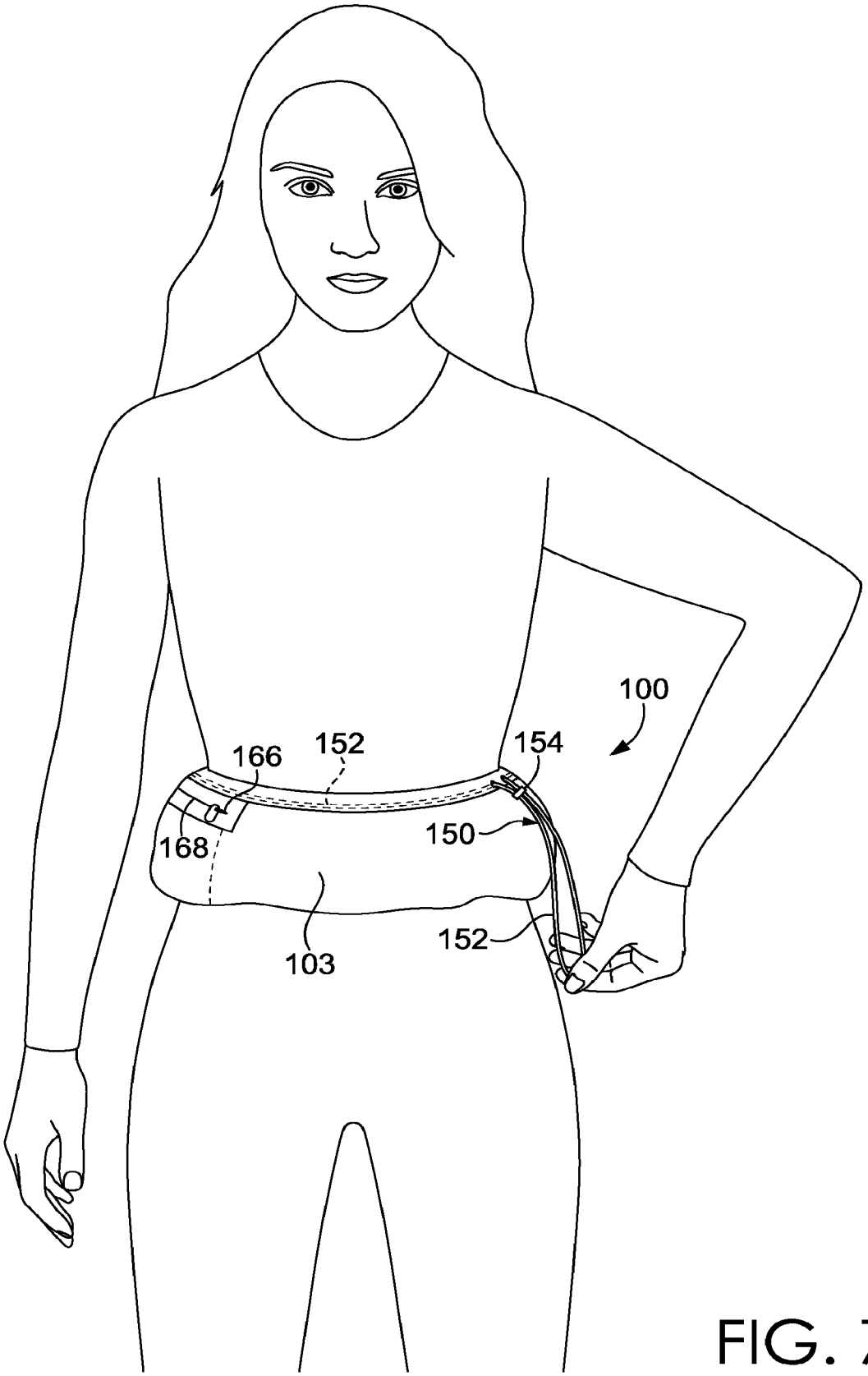

FIG. 7 illustrates the article of apparel 100 after the second tensioning mechanism 150 has been folded upward. As shown in FIG. 7, the second tensioning mechanism 150 may be used to apply circumferential tension in a manner similar to the first tensioning mechanism 140, previously described. By applying circumferential tension to the second tensioning mechanism 150, the doffed portion of the torso portion 105, and in some aspects, the first sleeve 114 and the second sleeve 118, are maintained in a stowed state.

As will be appreciated, stowing a portion of the article of apparel 100 may be performed while a wearer is engaged in activity because the wearer does not have to contort her arms away from and behind her body to doff the article of apparel 100. Additionally, it will be appreciated that stowing the portion of the article of apparel 100 in this manner secures the article of apparel 100 to the wearer so that constant adjustments do not have to be made, even when engaging in activity. The stowed article of apparel 100 provides the wearer additional safety during activity because the risk of a portion of the article of apparel 100, such as sleeves 114 or 118, falling downward and tripping the wearer is reduced or eliminated.

Having described how the article of apparel 100 may be stowed, FIG. 1 is again referenced to describe a first pocket 160 included in the example article of apparel 100. As illustrated, the first pocket 160 is located on the torso portion 105 between the first tensioning mechanism 140 and the second tensioning mechanism 150 (or the waist opening 110). In some aspects, the first pocket 160 comprises an outer opening 162 on an exterior aspect 101 of the article of apparel 100 and an inner opening 166 on an interior aspect 103 of the article of apparel 100. The inner opening 166 is shown in dashed lines in FIG. 1 because it will be appreciated that it opens on the interior aspect 103.

As shown in FIG. 1, the inner opening 166 of the first pocket 160 is positioned inferior to the outer opening 162 and spaced apart from the outer opening 162 by a second predetermined distance 169. In some aspects, the second predetermined distance 169 may be from about 8 cm to about 20 cm, from about 10 cm to about 18 cm, or from about 12 cm to about 16 cm.

Figure 8:
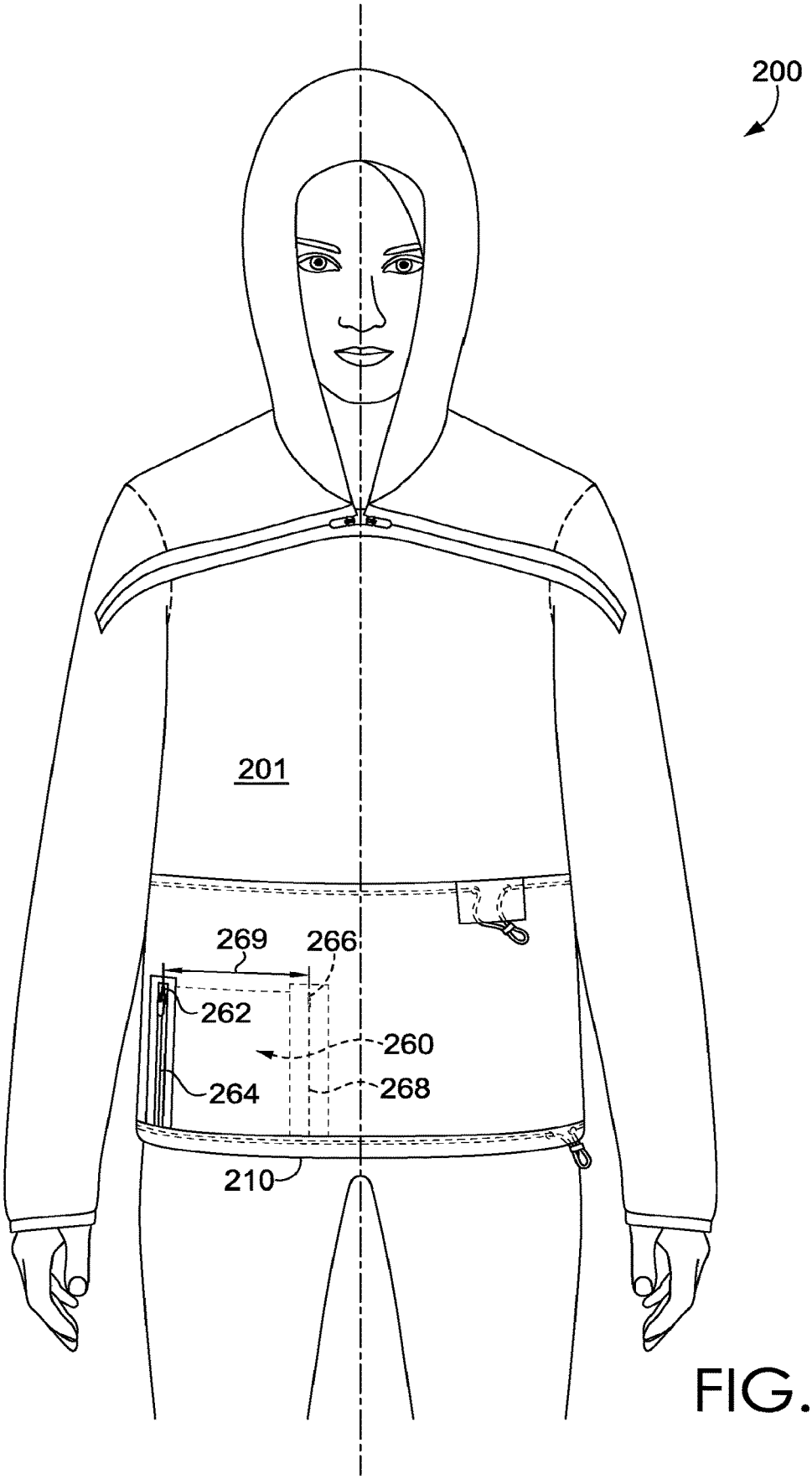
FIG. 8 illustrates another aspect of an exemplary upper-body article of apparel having a medial-lateral pocket, in accordance with aspects descried herein.

Referring briefly to FIG. 8, which illustrates another exemplary upper-body article of apparel 200, in some aspects, the inner opening 266 may be positioned medially with respect to the outer opening 262. In such cases, the inner opening 266 is spaced apart from the outer opening 262 by a third predetermined distance 269, which may be the same distance as the second predetermined distance 169 of FIG. 1, as measured from a lateral aspect of the article of apparel 200 to a medial aspect of the article of apparel 200. As illustrated in FIG. 8, both the inner opening 266 and the outer opening 262 are positioned generally perpendicular to the waist opening 210 of the article of apparel 200. By "generally" perpendicular, it is meant that the inner opening 266 and the outer opening 262 may be positioned at generally a 90° angle relative to the waist opening 210 or offset of 90° by ±20°. In some aspects, both the inner opening 266 and/or the outer opening 262 may be releasably secured by a closure mechanism 268 and/or 264, respectively, such as, for example, a zipper. It will be appreciated that, while not illustrated, in some aspects, the inner opening 266 may be positioned laterally with respect to the outer opening 262.

With reference again to FIG. 1, in some aspects, placement of the outer opening 162 of the first pocket 160 on the exterior aspect 101 of the article of apparel 100 allows the wearer to insert items into or retrieve items from the first pocket 160 when the article of apparel 100 is not stowed (i.e., is in a donned state). Additionally, now referencing FIG. 7, placement of the inner opening 166 on the interior aspect 103 of the article of apparel 100 allows the wearer to additionally insert items into or retrieve items from the first pocket 160 when at least a portion of the article of apparel 100 is stowed. Put another way, the wearer may insert items, such as keys or a phone, into the first pocket 160 via the outer opening 162 when the wearer has the entire torso portion 105 donned, yet be able to easily retrieve those items via the inner opening 162 after stowing at least the upper half of the torso portion 105. This is because when the second tensioning mechanism 150 is moved upward, as shown in FIG. 5 and FIG. 6, the interior aspect 103 of the article of apparel 100 becomes exposed, thereby exposing the inner opening 166 of the first pocket 160.

Figure 9:
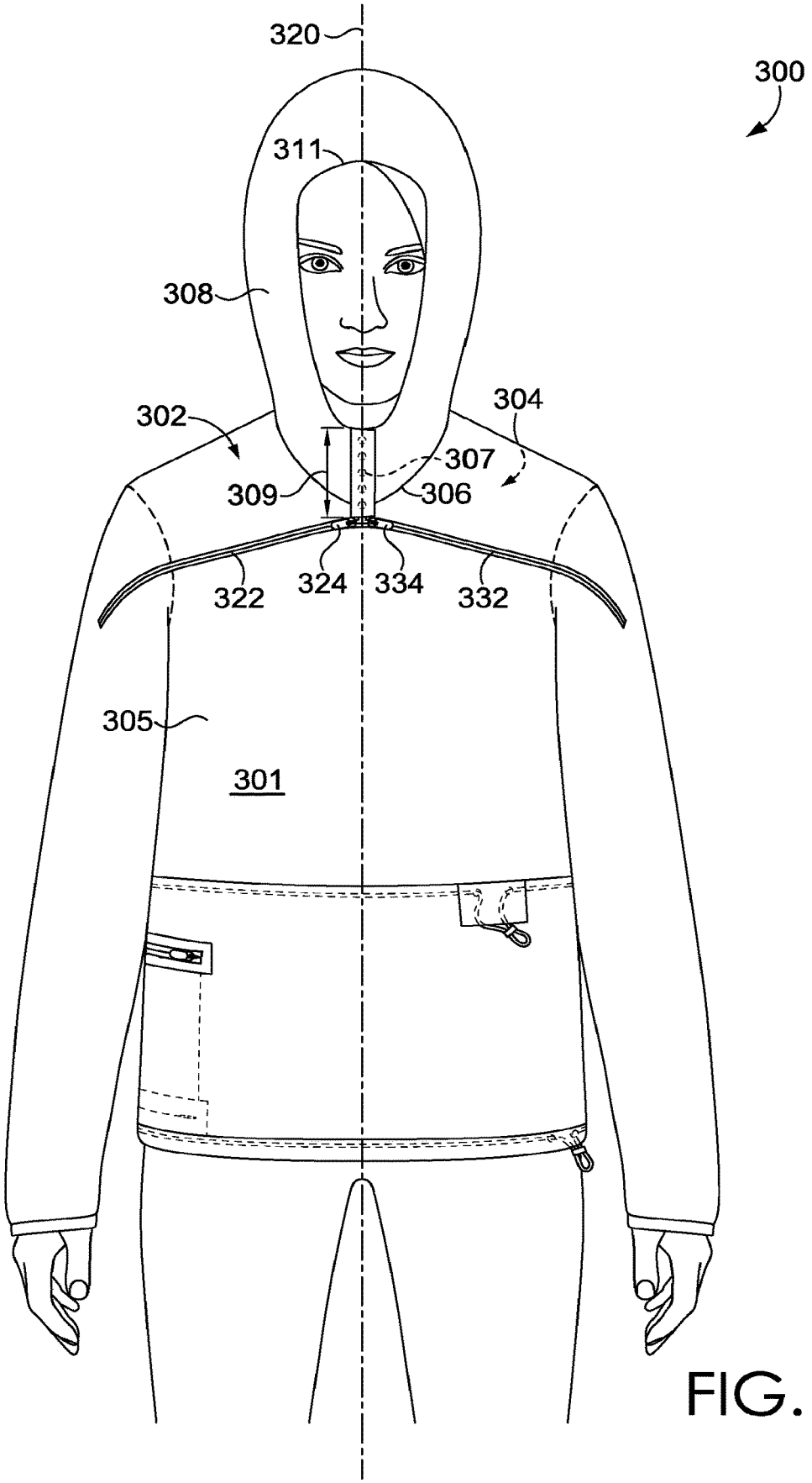
FIG. 9 illustrates another aspect of an exemplary upper-body article of apparel having an exemplary closure mechanism along a neckline opening, in accordance with aspects described herein.

Turning now to FIG. 9, another exemplary upper-body article of apparel 300 is illustrated in accordance with aspects herein. The article of apparel 300 includes a torso portion 305 that has a front aspect 302 and a back aspect 304 that define at least a neckline opening 306. In some aspects, the article of apparel 300 comprises a hood 308 extending from the neckline opening 306, the hood forming a facial opening 311. The article of apparel 300, as illustrated, also comprises a first slider mechanism 322 having a first slider pull 324 and a second slider mechanism 332 having a second slider pull 334. As shown, the first slider mechanism 322 and the second slider mechanism 332 are in a closed position where the first slider pull 324 and the second slider pull 334 abut one another near a vertical midline 320, and are inferior to and adjacent to the neckline opening 306.

The aspect of the article of apparel 300 illustrated in FIG. 9 further comprises a neckline closure mechanism 307 that is positioned along at least a portion of the neckline opening 306 on the front aspect 302. In some aspects, the neckline closure mechanism 307 may be superior to the first slider mechanism 322 and the second slider mechanism 332. In some aspects, when the article of apparel 300 is worn as intended and the neckline closure mechanism 307 is in a closed position, meaning that the neckline closure mechanism 307 is fastened, the neckline closure mechanism 307 may be superior to the first slider pull 324 and the second slider pull 334 when the first slider pull 324 and the second slider pull 334 are in the closed position. In some aspects, a length 309 of the neckline closure mechanism 307, when in the closed position, may be from about 1 mm to about 15 cm, from about 1 mm to about 10 cm, from about 1 mm to about 7 cm, from about 1 mm to about 5 cm, from about 1 mm to about 3 cm, from about 1 cm to about 5 cm, or from about 1 cm to about 3 cm.

In some cases, when the neckline closure mechanism 307 is in an open position, the neckline closure mechanism 307 may serve to increase the size of the neckline opening 306 to facilitate easy donning and doffing of the upper half of the article of apparel 300. In some cases, when the neckline closure mechanism 307 is in the closed position, the neckline closure mechanism 307 decreases the size of the facial opening 311 of the hood 308 so that the wearer has increased protection from inclement weather. While the neckline closure mechanism 307 is shown as a series of snaps, it is contemplated that the neckline closure mechanism 307 may be any closure mechanism, such as any of those previously discussed. While not shown, it is contemplated that in some aspects the neckline closure mechanism 307 may continuously extend into the first slider mechanism 322 and/or the second slider mechanism 332.

Figure 10:
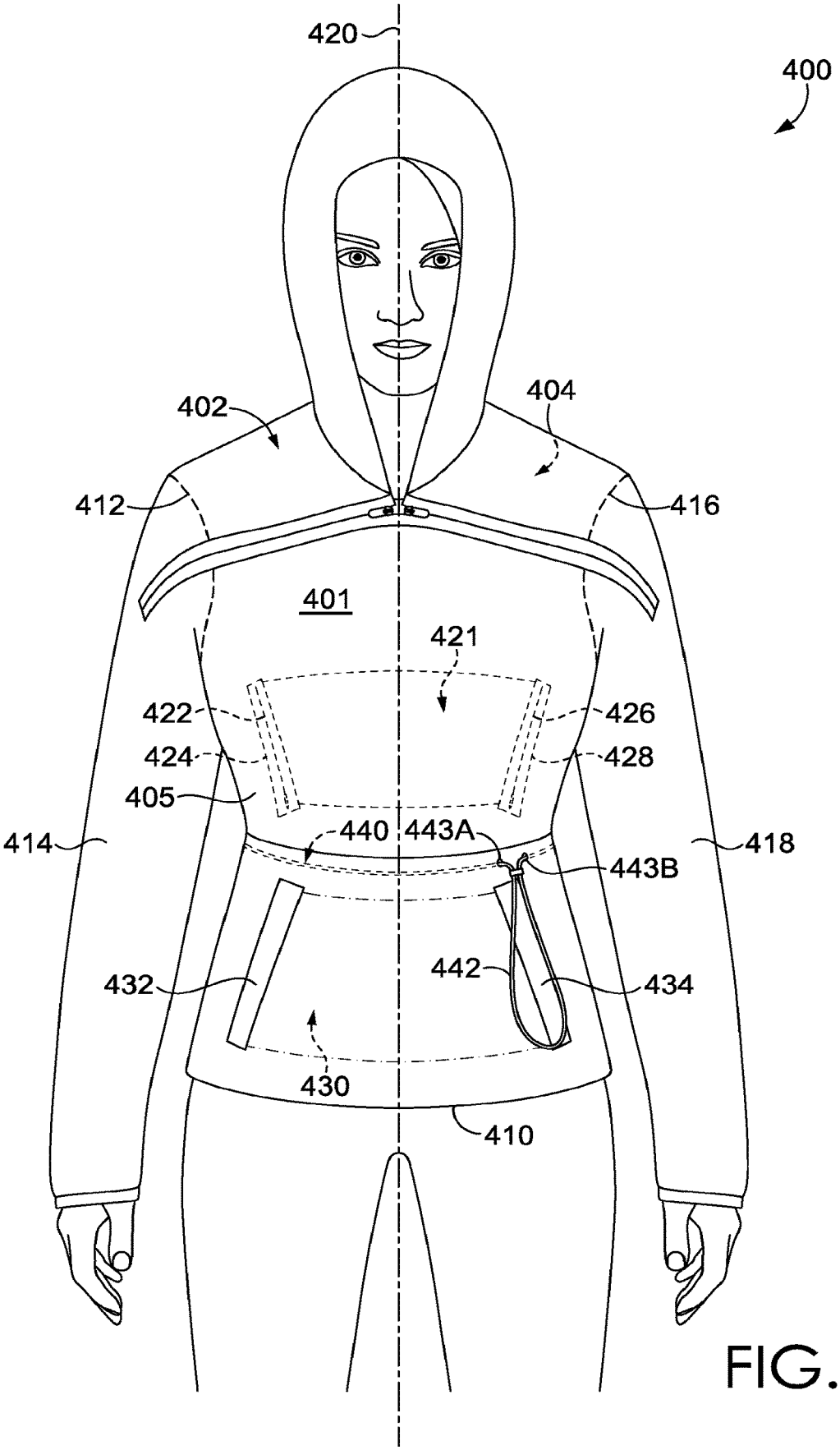
FIGS. 10-12 illustrate another exemplary method for doffing and storing another exemplary upper-body article of apparel having an exemplary inner pocket, in accordance with aspects described herein.
Figure 11:
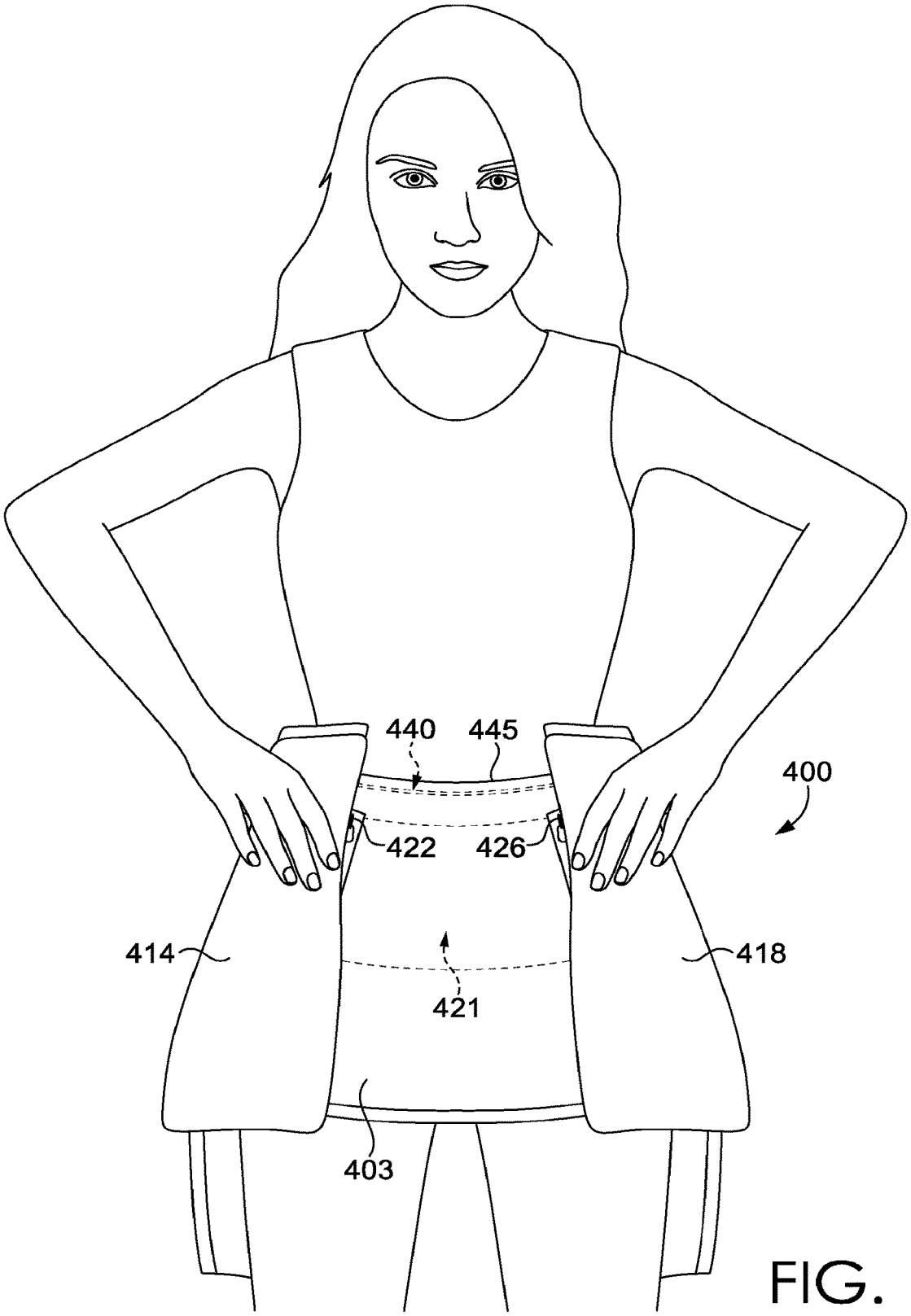
Figure 12:
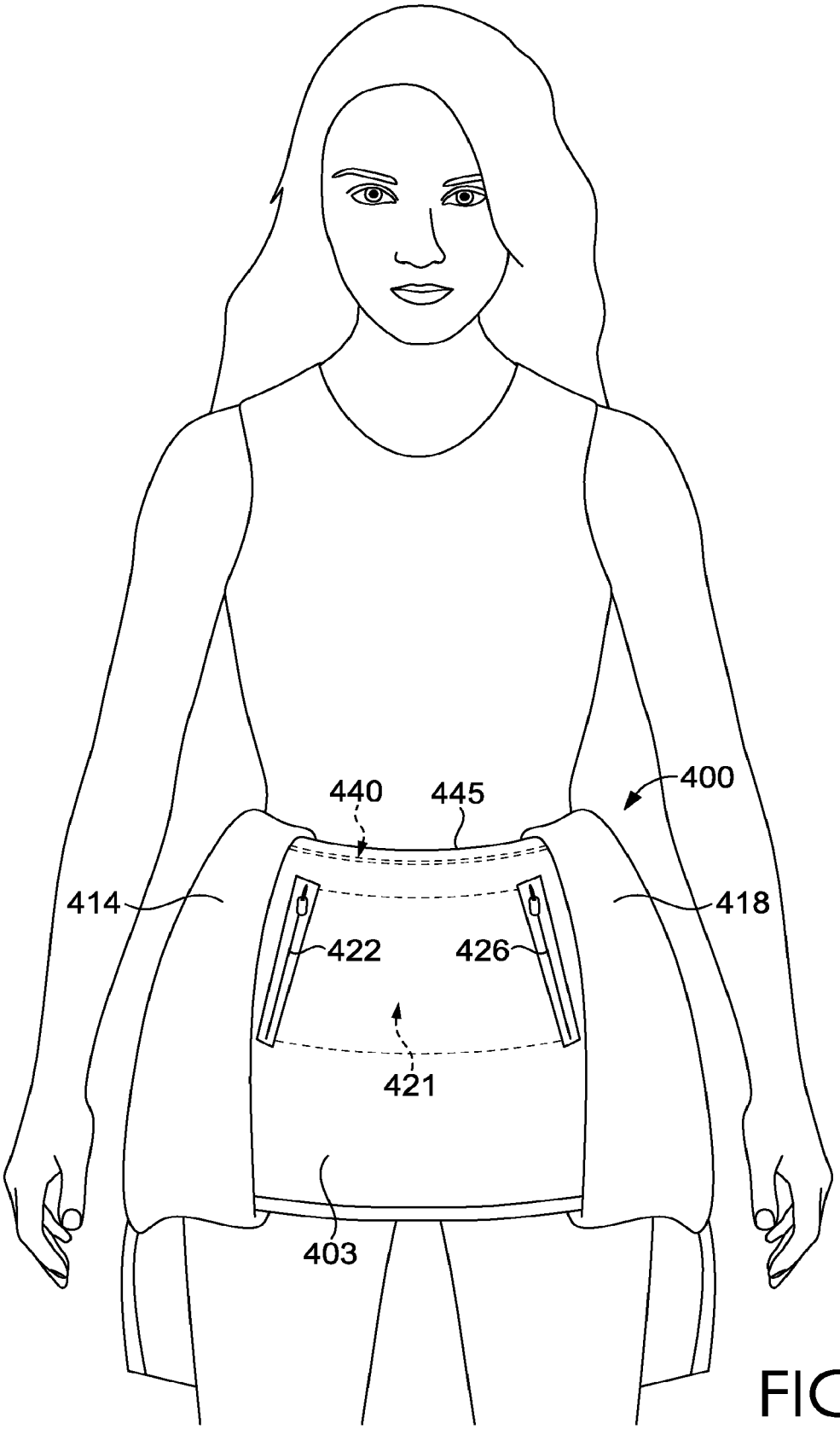

With reference now to FIGS. 10-12, another exemplary method for stowing another exemplary upper-body article of apparel 400 is provided in accordance with aspects herein. The article of apparel 400, as illustrated, comprises a torso portion 405 that has a front aspect 402 and a back aspect 404. Together, the front aspect 402 and the back aspect 404 define a waist opening 410, a first arm opening 412, and a second arm opening 416. As shown in FIG. 10, a first sleeve 414 extends from the first arm opening 412, and a second sleeve 418 extends from the second arm opening 416.

The article of apparel 400, as illustrated, further comprises a first pocket 421 and a second pocket 430. When the article of apparel 400 is fully donned and worn as intended, the first pocket 421 is superior to the second pocket 430 and is located on the front aspect 402 of the upper half of the torso portion 405, while the second pocket 430 is located on the front aspect 402 of the lower half of the torso portion 405. In some aspects, a tensioning mechanism 440 is located between the first pocket 421 and the second pocket 430, and is positioned parallel to but offset from the waist opening 410, similar to the tensioning mechanism 140 of the article of apparel 100. With respect to the article of apparel 400, unlike the article of apparel 100, the article of apparel 400 does not comprise a second tensioning mechanism.

In some aspects, the first pocket 421 may comprise one or more pocket openings. As shown in FIG. 10, the first pocket 421 comprises a first opening 422 and a second opening 426. In some aspects, the first opening 422 may be releasably secured by a first closure mechanism 424, while the second opening 426 may be releasably secured by a second closure mechanism 428. In some cases, the first opening 422 and the second opening 426 may open on an interior aspect of the article of apparel 400. While not shown, it is contemplated that one or more of the first opening 422 or the second opening 426 may additionally or alternatively open on an exterior aspect 401 of the article of apparel 400.

In some aspects, the first opening 422 may be located laterally with respect to a theoretical vertical midline 420. In some aspects, the second opening 426 may be located opposite the first opening 422 and lateral with respect to the theoretical vertical midline 420. In some aspects, a lower margin of the first opening 422 and/or a lower part of the second opening 426 may be located from about 0.1 cm to about 20 cm, from about 0.1 cm to about 15 cm, from about 0.1 cm to about 10 cm, from about 5 cm to about 20 cm, or from about 10 cm to about 15 cm superior to the tensioning mechanism 440. In some aspects, a length of the first opening 422 and/or the second opening 426 may be from about 5 cm to about 40 cm, from about 8 cm to about 37 cm, from about 10 cm to about 34 cm, from about 11 cm to about 31 cm, from about 14 cm to about 28 cm, from about 17 cm to about 25 cm, or from about 20 cm to about 22 cm. In some aspects, the first opening 422 may extend from the lower margin of the first opening 422 upward and away from the vertical midline 420 toward a shoulder area adjacent to the first arm opening 412. In some aspects, the second opening 426 may extend from the lower margin of the second opening 426 upward and away from the vertical midline 420 toward a shoulder area adjacent to the second arm opening 416. However, it is contemplated herein that the openings 422 and 426 may extend vertically upward instead of angling outward or may even angle inward. Any and all aspects, and any variation thereof, are contemplated as being within aspects herein.

In some aspects, the article of apparel 400 may additionally or alternatively comprise a second pocket 430. The second pocket 430 may have one or more pocket openings, illustrated in FIG. 10 as a third opening 432 and a fourth opening 434. While not shown in FIG. 10, it will be understood that each of the third opening 432 and/or the fourth opening 434 may be releasably secured by a closure mechanism. As shown in FIG. 10, one or more of the third opening 432 and/or the fourth opening 434 may open on the exterior aspect 401 of the article of apparel 400.

In some aspects, the third opening 432 may be located laterally with respect to the theoretical vertical midline 420. In some aspects, the fourth opening 434 may be located opposite the third opening 432 and lateral with respect to the theoretical vertical midline 420. In some aspects, an upper margin of the third opening 432 and/or an upper margin of the fourth opening 434 may be located from about 0.1 cm to about 20 cm, from about 0.1 cm to about 15 cm, from about 0.1 cm to about 10 cm, from about 5 cm to about 20 cm, or from about 10 cm to about 15 cm inferior to the tensioning mechanism 440. In some aspects, the third opening 432 and/or the fourth opening 434 may be from about 5 cm to about 40 cm, from about 8 cm to about 37 cm, from about 10 cm to about 34 cm, from about 11 cm to about 31 cm, from about 14 cm to about 28 cm, from about 17 cm to about 25 cm, or from about 20 cm to about 22 cm in length. In some aspects, the third opening 432 may extend from the upper margin of the third opening 432 downward and away from the vertical midline 420 toward the waist opening 410. In some aspects, the fourth opening 434 may extend from the upper margin of the fourth opening 434 downward and away from the vertical midline 420 toward the waist opening 410. It is also contemplated that the openings 432 and 434 may be more vertically oriented instead of angularly oriented. It is also contemplated that the openings 432 and 434 may angle inward as they extend toward the waist opening 410. Any and all aspects, and any variation thereof, are contemplated as being within aspects herein.

In some aspects, the tensioning mechanism 440 of the article of apparel 400 has a tensioning cord 442. The tensioning cord 442 may have a portion that is slidably affixed to the article of apparel 400 using manners previously discussed, such as a tunnel structure in the article of apparel 400. In some aspects, such as that shown in FIG. 10, the article of apparel 400 may have one or more transition areas, such as transition area 443A and transition area 443B, where the tensioning cord 442 exits, for instance, the tunnel structure. While not illustrated in FIG. 10, in some aspects, the transition area 443A and/or the transition area 443B may be located within the second pocket 430. In these aspects, the portion of the tensioning cord 442 that is external to the article of apparel 400 may not be readily visible, leading to an aesthetically pleasing article. Additionally, having the transition area 443A and/or the transition area 443B located within the second pocket 430 allows for the external portion of the tensioning cord 442 to be stowed within the second pocket 430 where it is less likely to hinder the wearer during activity and where it is less likely to unintentionally catch on objects, which adds a safety feature to the garment 400. As will be appreciated, the functionality of the tensioning mechanism 440 is not reduced in these aspects, as access to the tensioning mechanism 440 may be provided by the third opening 432 and/or the fourth opening 434.

FIGS. 11 and 12 illustrate an exemplary method for stowing the article of apparel 400. The article of apparel 400 is shown in FIG. 11 after the wearer has doffed the upper part of the torso portion 405, the first sleeve 414, and the second sleeve 418, for example, using methods previously described with respect to the article of apparel 100. When doffed, the upper part of the torso portion 405 is folded downward at a tension area 445 that is created by the circumferential tension applied by the tensioning mechanism 440 to the torso portion 405 and the wearer. In doing so, the interior aspect 403 of the upper part of the torso portion 405 is exposed externally. This causes the first opening 422 and the second opening 426 to also be externally exposed, thus allowing the wearer external access to the first pocket 421.

As shown in FIG. 11, in some aspects, after having been doffed, the sleeves 414 and 418 may be tucked and secured by the tension area 445. In this aspect, the wearer may push the ends of the sleeves 414 and 418 that are opposite the first arm opening 412 and the second arm opening 416, respectively, behind the tension area 445 so that the sleeves 414 and 418 are secured between the article of apparel 400 and the wearer by the circumferential tension applied by the tensioning mechanism 440, thus creating the stowed state that is shown in FIG. 12. In the stowed state, the article of apparel 400 is secured to the wearer so that she does not have to constantly adjust the article of apparel 400 during activity. This further reduces the risk to the wearer that she may trip over a portion of the article of apparel 400, such as the sleeves 414 and 418, as they are less likely to become unsecured and fall downward.

Figure 14:
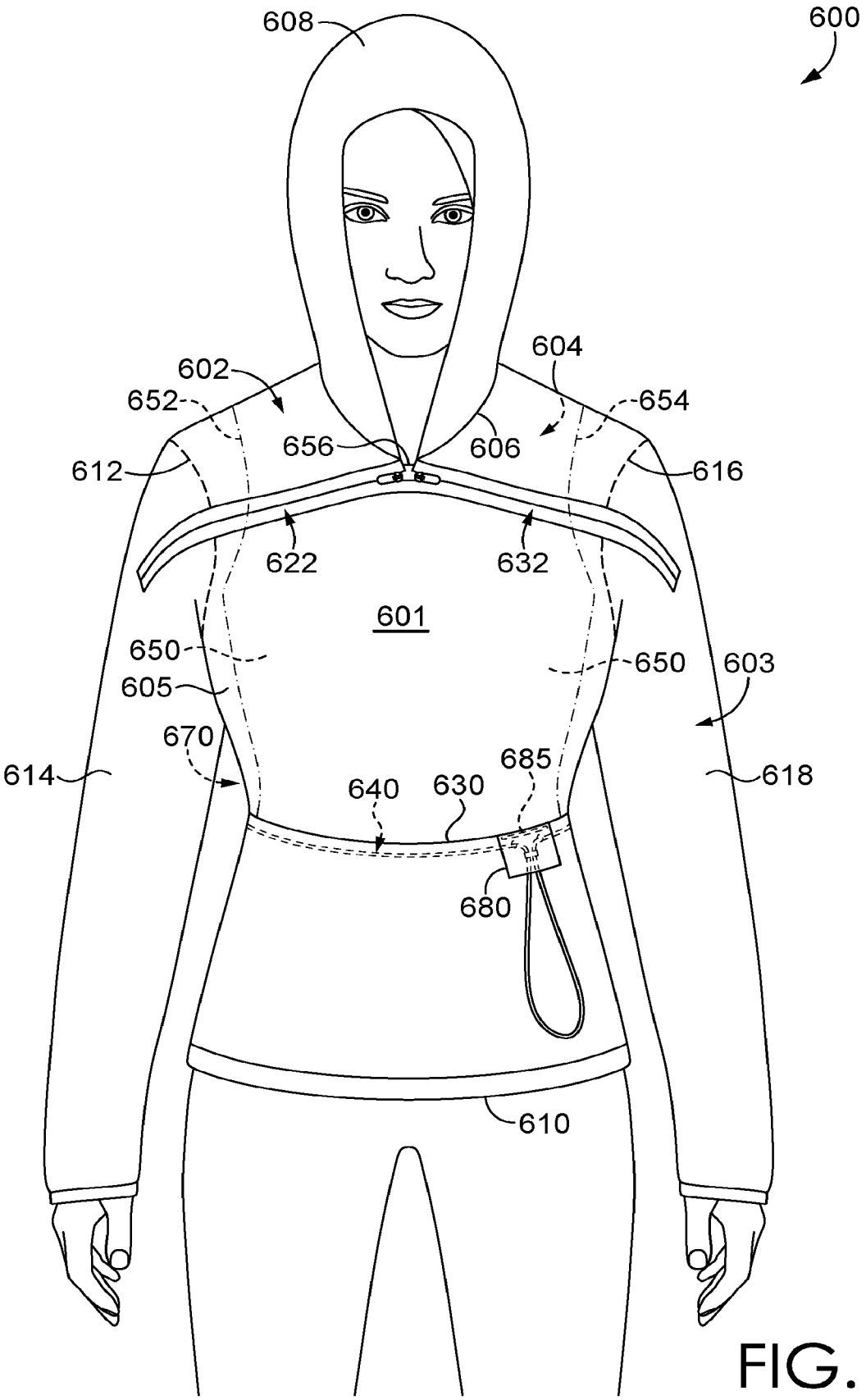
FIGS. 14-15 illustrate an exemplary method for doffing and storing an exemplary upper-body apparel system having an inner article and an outer article.
Figure 15:
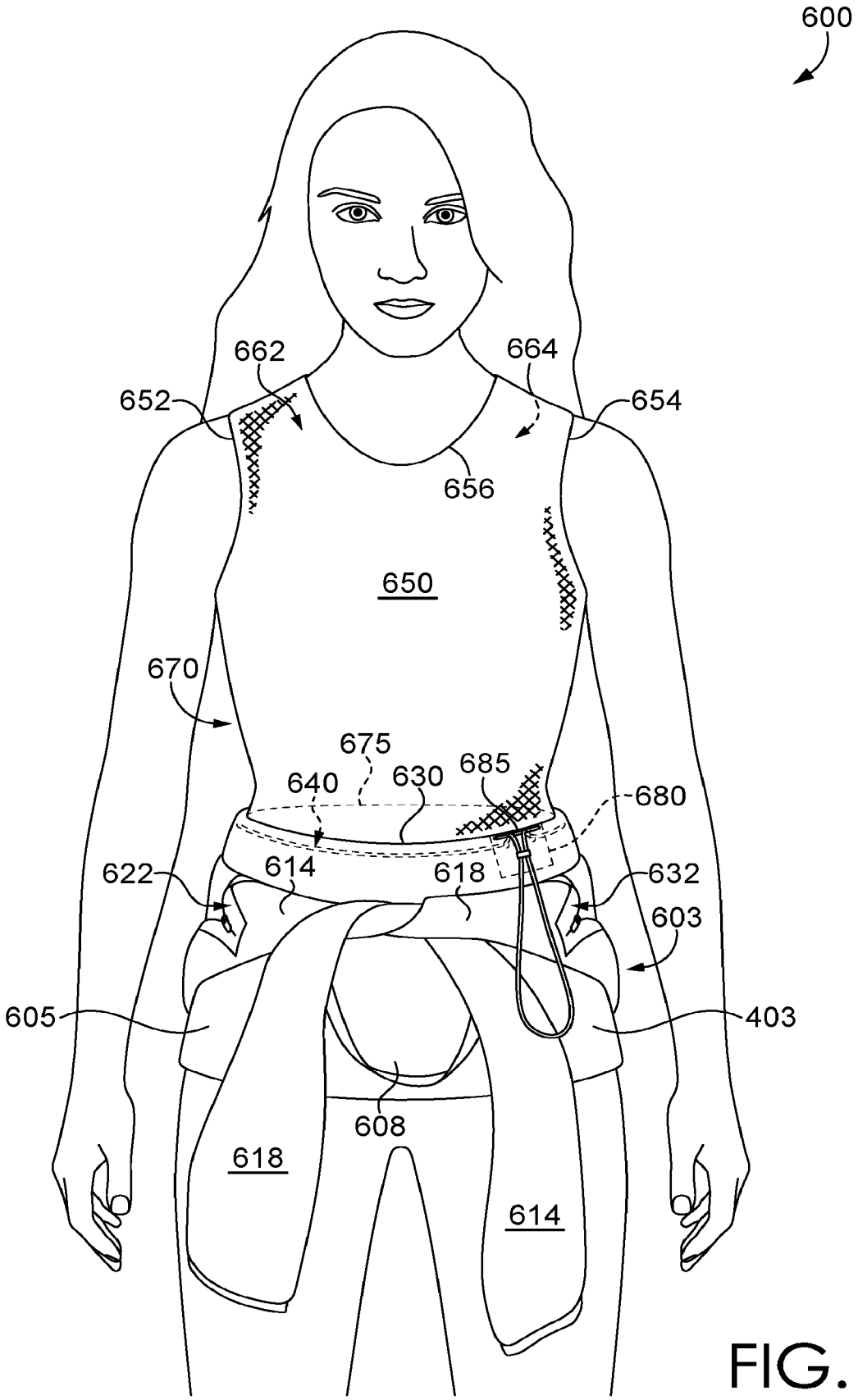

Turning now to FIGS. 14 and 15, an upper-body apparel system 600 is illustrated. The apparel system 600, as illustrated, comprises an outer article 603 having an outer article torso portion 605 that has an outer article front aspect 602 and an outer article back aspect 604. Together, the outer article front aspect 602 and the outer article back aspect 604 define an outer article neckline opening 606 and an outer article waist opening 610. In some aspects, such as the one illustrated in FIG. 14, a hood 608 may extend from the outer article neckline opening 606. Additionally, as illustrated, the outer article front aspect 602 and the outer article back aspect 604 further define an outer article first arm opening 612 and an outer article second arm opening 616. As shown in FIG. 14, an outer article first sleeve 614 extends from the outer article first arm opening 612, and an outer article second sleeve 618 extends from the outer article second arm opening 616. Like other aspects, the outer article sleeves 614 and 618 may comprise any of short sleeves, mid-length sleeves, long sleeves, and the like.

The outer article torso portion 605 is also illustrated as having an outer article first closure mechanism 622 and an outer article second closure mechanism 632, which may be positioned on the outer article torso portion 605 in a manner similar to aspects previously described with respect to, for example, the article of apparel 100. Further, the outer article torso portion 605 is illustrated as having a tensioning mechanism 640 that extends circumferentially around the outer article torso portion 605 and is slidably affixed to the outer article torso portion 605. In exemplary aspects, the tensioning mechanism 640 is positioned parallel to the outer article waist opening 610 and is spaced apart from the outer article waist opening 610 by a predetermined distance that is from about 10 cm to about 50 cm, from about 10 cm to about 40 cm, from about 10 cm to about 30 cm, from about 12 cm to about 28 cm, from about 14 cm to about 26 cm, from about 16 cm to about 24 cm, from about 20 cm to about 30 cm, from about 23 cm to about 30 cm, or from about 25 cm to about 30 cm.

In some aspects, the outer article torso portion 605 may comprise a flap 680. In some cases, the flap 680 may be affixed to the outer article front aspect 602 of the outer article torso portion 605 so that it covers at least a portion of the tensioning mechanism 640. In some cases, the flap 685 may be affixed on the outer article torso portion 605 at a distance that is from about 1 mm to about 6 cm, from about 2 mm to about 5 cm, from about 3 mm to about 4 cm, from about 4 mm to about 3 cm, or from about 5 mm to about 2 cm superior to the tensioning mechanism 640. In some cases, the flap 680 may cover an exterior portion of the tensioning mechanism 640 that exits from the outer article torso portion 605, for example, such as exiting from a tunnel structure where a portion of the tensioning mechanism 640 is affixed to the outer article torso portion 605.

In some aspects, the outer article torso portion 605 may comprise an opening 685. The opening may be from about 1 mm to about 5 cm, from about 1 mm to about 4 cm, from about 1 mm to about 3 cm, from about 1 mm to about 2 cm, from about 5 mm to about 2 cm, or from about 1 cm to about 2 cm in length as measured from a medial end of the opening 685 to a lateral end of the opening 685. The opening 685 may open on both the outer article interior aspect 603 and the outer article exterior aspect 601. In some aspects, the opening 685 may be positioned adjacent to the tensioning mechanism and between two transition areas where the tensioning mechanism 640 exits from the outer article torso portion 605. In some cases, the opening 685 may be positioned adjacent to the tensioning mechanism 640 and from about 0.1 mm to about 5 cm, from about 1 mm to about 5 cm, from about 5 mm to about 4 cm, from about 5 mm to about 3 cm, from about 5 mm to about 2 cm, or from about 5 mm to about 1 cm superior or inferior to the position of the tensioning mechanism 640. In some cases, the opening 685 may be partially or entirely covered by the flap 680 on the outer article front aspect 602. In such cases, the flap 680 helps to prevent external moisture from going through the opening 685 to the wearer, such as in cases where the wearer is wearing the apparel system 600 during inclement weather, such as rain or snow.

With continued reference to FIGS. 14 and 15, the apparel system 600 further comprises an inner article 670 shown by the alternating dashed-dot line. As illustrated, an inner article torso portion 650 has an inner article front aspect 662 and an inner article back aspect 664 that, together, define an inner article neckline opening 656, an inner article waist opening 675, an inner article first arm opening 652, and an inner article second arm opening 654. Although not illustrated in FIG. 14, an optional inner article first sleeve and an optional inner article second sleeve may respectively extend from the inner article first arm opening 652 and the inner article second arm opening 654. It will be understood that the sleeve length for the inner article 670 may be the same as or different than the sleeve length for the outer article 603, and like other aspects, may be any sleeve length.

In some aspects, the inner article waist opening 675 terminates at a location generally corresponding to the tensioning mechanism 640. In some aspects, such as the one illustrated in FIGS. 14 and 15, and further discussed below, the inner article waist opening 675 is affixed to the outer article 603 at a location generally corresponding to the tensioning mechanism 640. In some aspects, the inner article torso portion 650 may extend inferior to the tensioning mechanism 640, such that the inner article waist opening 675 terminates inferior to the tensioning mechanism 640. Any and all aspects, and any variation thereof, are contemplated as being within aspects herein.

In some aspects, the inner article 670 may be permanently or releasably affixed to the outer article 603, shown in FIGS. 14 and 15 at affixation site 630. As illustrated, the inner article waist opening 675 is circumferentially affixed to the outer article 603 along the affixation site 630. However, in some aspects, the affixation site 630 may comprise one or more disparate locations where the inner article waist opening 675 is affixed to the outer article 603. For example, the inner article waist opening 675 may be partially or intermittently circumferentially affixed to the outer article 603 along the affixation site 630. As illustrated, the affixation site 630 is parallel with and may be superior to the tensioning mechanism 440. In some aspects, the affixation site 630 is located from about 0.1 cm to about 15 cm, from about 0.1 cm to about 10 cm, from about 0.1 cm to about 5 cm, from about 1 cm to about 10 cm, from about 3 cm to about 8 cm, or from about 3 cm to about 5 cm superior to the tensioning mechanism 640. In aspects where the affixation site 630 is inferior to the tensioning mechanism 440, not illustrated, the affixation site 630 may be located a similar distance from the tensioning mechanism 440. While FIGS. 14 and 15 illustrate the affixation site 630 as corresponding to the inner article waist opening 675, it will be appreciated that, in some aspects, the inner article 670 is affixed to the outer article 603 at a location on the inner article 670 other than the inner article waist opening 675.

FIG. 15 illustrates the apparel system 600 in an exemplary stowed state. Here, the stowed state is illustrated as having the outer article first sleeve 614 releasably tied to the outer article second sleeve 618 around the lower half of the outer article torso portion 605 after the upper half of the outer article torso portion 605 has been doffed by the wearer, for example, using methods previously described. The stowed state of FIG. 15 is also beneficial to the wearer because she does not have to continually adjust the outer article of the apparel system 600 while engaging in activity because it is secured to the wearer through the circumferential tension applied by the tensioning mechanism 640. In contrast to conventional jackets, the tied sleeves 614 and 618 are less likely to become untied because the outer article is better secured to the wearer such that it does not shift about during activity.

In some aspects of the apparel system 600 that comprise the opening 685, the opening 685 may provide a way to access the tensioning mechanism 640 when the apparel system is in the stowed state, such as shown in FIG. 15. For example, when the article is transitioned to the stowed state, a portion of the tensioning mechanism 640, such as the portion that was originally external to the article of apparel 600 in FIG. 14, may be pulled through the opening 685 from the outer article exterior aspect 601 to the outer article interior aspect 603 so that it is accessible to the wearer in the stowed state.

Throughout this disclosure, multiple aspects of an article of apparel and apparel system have been provided. For the sake of clarity and brevity, not all combinations of the parts of the article of apparel and apparel system have been illustrated and described, particularly related to the tensioning mechanisms and the pockets. While they may not be illustrated or described, other aspects of the article of apparel and apparel system having different arrangements of parts are contemplated within the scope of this disclosure. As an example, the article of apparel 100 of FIG. 1 is illustrated as having a first pocket 160 that has openings 162 and 166 in the superior-inferior direction relative to one another, while the article of apparel 400 of FIG. 10 has a second pocket 430 with openings 432 and 434 that are located opposite each other and lateral from a vertical midline 420. However, it is contemplated that the first pocket 160 of FIG. 1 could just as easily be utilized with the article of apparel 400, and similarly, the second pocket 430 of FIG. 10 could just as easily be utilized with the article of apparel 100. Using another example, the second tensioning mechanism of the article of apparel 100 may also be utilized with the apparel system 600 of FIG. 14. In yet another non-exclusive example, the opening 685 of the apparel system 600 may also be utilized with the article of apparel 100 of FIGS. 1-7, or just as easily be utilized with the article of apparel 400 of FIGS. 10-12, which may additionally include a flap in some aspects. This is just a sample of examples of how various parts of the various aspects of the articles of apparel and apparel systems can be interchangeable. All such combinations are contemplated by the inventors and are intended to be within the scope of this disclosure.

Aspects of the present disclosure have been described with the intent to be illustrative rather than restrictive. Alternative aspects will become apparent to those skilled in the art that do not depart from its scope. A skilled artisan may develop alternative means of implementing the described improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A method of transforming a stowable article of apparel for an upper torso of a wearer, the method comprising:

transitioning a first slider mechanism from a first closed position to a first open position, the first slider mechanism having a first stop and a second stop, the first stop positioned inferior to a neckline opening at a front midline of the stowable article of apparel, the second stop positioned adjacent to a first arm opening;

transitioning a second slider mechanism from a second closed position to a second open position, the second slider mechanism having a third stop and a fourth stop, the third stop positioned inferior to the neckline opening at the front midline of the stowable article of apparel, the fourth stop positioned adjacent to a second arm opening;

doffing at least an upper half of the stowable article of apparel via an opening, the opening formed by the first slider mechanism comprising the first open position and the second slider mechanism comprising the second open position, wherein, when doffed, the upper half comprises a portion of the stowable article of apparel that is superior to a first tensioning mechanism, the first tensioning mechanism extending circumferentially around the stowable article of apparel and positioned parallel with a waist opening of the article of apparel; and stowing the upper half of the article of apparel in a pouch formed between the first tensioning mechanism and a second tensioning mechanism, the second tensioning mechanism extending circumferentially around article of apparel and positioned inferior to and parallel with the first tensioning mechanism.

2. The method of claim 1, wherein the first tensioning mechanism comprises a first tensioning cord extending circumferentially around the stowable article of apparel through a tunnel structure, and the method further comprises:

tensioning the first tensioning mechanism by pulling a portion of the first tensioning mechanism through an opening in the tunnel structure; and securing the first tensioning cord with a first cord lock.

3. The method of claim 1, wherein the second tensioning mechanism is coincident with the waist opening.

4. The method of claim 1, wherein the pouch is formed from a portion of the stowable article of apparel between the first tensioning mechanism and the second tensioning mechanism.

5. The method of claim 1, wherein the stowable article of apparel comprises an interior aspect, and a portion of the interior aspect is outward facing when the pouch is formed.

6. The method of claim 1, wherein stowing the upper half of the stowable article of apparel exposes an inner pocket opening of a pocket located between the first tensioning mechanism and the second tensioning mechanism.

7. The method of claim 1, further comprising opening a neckline closure mechanism, the neckline closure mechanism extending from the neckline opening to a position superior to the first slider mechanism in the first closed position and the second slider mechanism in the second closed position.

8. A method of transforming a stowable article of apparel for an upper torso of a wearer, the method comprising:

donning an article of apparel comprising:

a torso portion comprising a front aspect and a back aspect that together define at least a neckline opening, a waist opening, a first arm opening, and a second arm opening;

a first tensioning mechanism extending circumferentially around the torso portion, the first tensioning mechanism being parallel with the waist opening; and a second tensioning mechanism extending circumferentially around the torso portion, the second tensioning mechanism positioned inferior to and parallel with the first tensioning mechanism;

doffing at least an upper half of the article of apparel via an opening of the article of apparel, the opening positioned inferior to the neckline opening and extending horizontally across the front aspect;

tensioning the first tensioning mechanism;

folding a waist opening edge of the waist opening upward toward the first tensioning mechanism, wherein folding the waist opening edge upward forms a pouch around the upper half of the article of apparel; and tensioning the second tensioning mechanism, thereby stowing the upper half within the pouch.

9. The method of claim 8, wherein the first tensioning mechanism comprises a first tensioning cord extending circumferentially around the article of apparel through a tunnel structure, and the method further comprises:

tensioning the first tensioning mechanism by pulling a portion of the first tensioning mechanism through an opening in the tunnel structure; and securing the first tensioning cord with a first cord lock.

10. The method of claim 8, wherein the second tensioning mechanism is coincident with the waist opening.

11. The method of claim 8, wherein the pouch is formed from a portion of the article of apparel between the first tensioning mechanism and the second tensioning mechanism.

12. The method of claim 8, wherein the article of apparel comprises an interior aspect, and a portion of the interior aspect is outward facing when the pouch is formed.

13. The method of claim 8, wherein folding the waist opening edge upward toward the first tensioning mechanism exposes an inner pocket opening of a pocket located between the first tensioning mechanism and the second tensioning mechanism.

14. The method of claim 8, further comprising opening a neckline closure mechanism, the neckline closure mechanism extending from the neckline opening to the opening across the front aspect.

15. A method of transforming a stowable article of apparel for an upper torso of a wearer, the method comprising:

donning an article of apparel comprising:

a torso portion comprising a front aspect and a back aspect that together define at least a neckline opening, a waist opening, a first arm opening, and a second arm opening;

a first sleeve extending from the first arm opening;

a second sleeve extending from the second arm opening;

a tensioning mechanism extending circumferentially around the torso portion, the tensioning mechanism positioned superior to and parallel with the waist opening, and spaced apart from the waist opening by a predetermined distance;

doffing at least an upper half of the article of apparel via an opening of the article of apparel, the opening positioned inferior to the neckline opening and extending horizontally across the front aspect, wherein the upper half of the article comprises the first sleeve and the second sleeve;

tensioning the tensioning mechanism;

securing the first sleeve of the upper half within a tensioning area created by tensioning the tensioning mechanism; and securing the second sleeve of the upper half within the tensioning area.

16. The method of claim 15, wherein the tensioning mechanism comprises a tensioning cord extending circumferentially around the article of apparel through a tunnel structure, and the method further comprises:

tensioning the tensioning mechanism by pulling a portion of the tensioning mechanism through an opening in the tunnel structure; and securing the tensioning cord with a cord lock.

17. The method of claim 15, further comprising opening a neckline closure mechanism, the neckline closure mechanism extending from the neckline opening to the opening across the front aspect.

18. The method of claim 15, wherein the article of apparel further comprises an interior aspect, and a portion of the interior aspect is exposed externally when the upper half of the article of apparel is doffed.

19. The method of claim 15, wherein the article of apparel further comprises a pocket positioned on an interior aspect of the upper half of the article of apparel, wherein doffing the upper half of the article of apparel exposes an opening of the pocket.

20. The method of claim 15, wherein the first sleeve is secured within the tensioning area at a first sleeve end that is opposite the first arm opening, and wherein the second sleeve is secured within the tensioning area at a second sleeve end that is opposite the second arm opening.

* * * * *